US009114951B2

(12) United States Patent
Igarashi

(10) Patent No.: US 9,114,951 B2
(45) Date of Patent: Aug. 25, 2015

(54) SHEET PROCESSING APPARATUS, CONTROL METHOD THEREFOR AND STORAGE MEDIUM

(71) Applicant: CANON KABUSHIKI KAISHA, Tokyo (JP)

(72) Inventor: Hiroya Igarashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 8 days.

(21) Appl. No.: 14/086,076

(22) Filed: Nov. 21, 2013

(65) Prior Publication Data

US 2014/0151958 A1 Jun. 5, 2014

(30) Foreign Application Priority Data

Dec. 3, 2012 (JP) ..... 2012-264736

(51) Int. Cl.

| | |
|---|---|
| ***B65H 31/10*** | (2006.01) |
| ***B65H 31/24*** | (2006.01) |
| ***B65H 31/38*** | (2006.01) |
| ***B65H 43/02*** | (2006.01) |
| ***G03G 15/00*** | (2006.01) |

(52) U.S. Cl.

CPC ..... *B65H 31/10* (2013.01); *B65H 31/24* (2013.01); *B65H 31/38* (2013.01); *B65H 43/02* (2013.01); *G03G 15/6547* (2013.01); *B65H 2301/4219* (2013.01); *B65H 2405/332* (2013.01); *B65H 2511/20* (2013.01); *B65H 2511/30* (2013.01); *B65H 2511/414* (2013.01); *B65H 2511/515* (2013.01); *B65H 2801/27* (2013.01); *G03G 2215/00911* (2013.01)

(58) Field of Classification Search

CPC ..... B65H 31/34; B65H 31/36; B65H 31/38; B65H 31/40; B65H 2301/4222; B65H 2407/30; B65H 2601/253; B65H 2601/2531

USPC ..... 271/220, 221; 270/58.12, 16, 17, 27

See application file for complete search history.

(56) References Cited

U.S. PATENT DOCUMENTS

| | | | | |
|---|---|---|---|---|
| 5,590,871 | A * | 1/1997 | Okabe et al. | 270/58.27 |
| 5,722,650 | A * | 3/1998 | Yamamoto et al. | 270/58.02 |
| 8,348,274 | B2 * | 1/2013 | Mutsuno | 271/288 |
| 8,387,974 | B2 * | 3/2013 | Hayashi | 271/213 |
| 8,657,277 | B2 * | 2/2014 | Satsukawa | 270/58.09 |
| 8,770,571 | B2 * | 7/2014 | Ando et al. | 270/58.17 |
| 2002/0050681 | A1 * | 5/2002 | Hosaka | 271/207 |
| 2007/0108698 | A1 * | 5/2007 | Tamura et al. | 271/220 |
| 2008/0088081 | A1 * | 4/2008 | Miwa et al. | 271/210 |
| 2008/0099972 | A1 * | 5/2008 | Hayashi | 270/18 |
| 2010/0270725 | A1 * | 10/2010 | Nakajima | 270/58.3 |
| 2013/0026695 | A1 * | 1/2013 | Tokuma | 270/58.07 |
| 2014/0061991 | A1 * | 3/2014 | Shimura et al. | 270/1.01 |
| 2014/0061993 | A1 * | 3/2014 | Shimura et al. | 270/58.09 |
| 2015/0003939 | A1 * | 1/2015 | Abe | 412/33 |

FOREIGN PATENT DOCUMENTS

JP 2006-206331 A 8/2006

* cited by examiner

*Primary Examiner* — Jeremy R Severson

(74) *Attorney, Agent, or Firm* — Fitzpatrick, Cella, Harper & Scinto

(57) ABSTRACT

A sheet processing apparatus includes an alignment unit configured to align sheets stacked on a stack tray. The sheet processing apparatus determines whether or not a part of sheets stacked on the stack tray has been removed from the stack tray. When it is determined that a part of sheets stacked on the stack tray has been removed from the stack tray, the sheet processing apparatus inhibits an alignment of the sheets using the alignment unit.

15 Claims, 16 Drawing Sheets

POSITIONS OF ALIGNMENT PLATES WHEN ALIGNMENT IS FINISHED

POSITIONS OF ALIGNMENT PLATES THAT HAVE BEEN RAISED OFF TRAY

POSITIONS OF ALIGNMENT PLATES FOR ACCEPTING NEXT SHEET

POSITIONS OF ALIGNMENT PLATES COMING INTO CONTACT WITH ALREADY-STACKED SHEETS

POSITIONS OF ALIGNMENT PLATES WHEN SHEET IS DISCHARGED

POSITIONS OF ALIGNMENT PLATES WHEN EXECUTING ALIGNMENT

ALIGNMENT WAITING POSITIONS OF ALIGNMENT PLATES

SHEET PROCESSING APPARATUS, CONTROL METHOD THEREFOR AND STORAGE MEDIUM

BACKGROUND OF THE INVENTION

1. Field of the Invention

The present invention relates to a sheet processing apparatus that has a function of aligning sheets stacked on a stack tray, a control method for the sheet processing apparatus, and a storage medium.

2. Description of the Related Art

For sheet processing apparatuses that stack a large number of sheets, there has been demand for the ability to discharge and align the sheets with a high degree of accuracy. Japanese Patent Laid-Open No. 2006-206331 suggests a sheet alignment process in which alignment members are provided on a stack tray, and sheets are piled up in such a manner that the positions of edge surfaces of the sheets parallel to a sheet discharge direction are lined up by the alignment members coming into and out of contact with the edge surfaces of the sheets.

The aforementioned conventional technique has the following problem. For example, if a user removes a part of sheets stacked on the stack tray, there is a possibility that sheets stacked on the stack tray may be misaligned. If an alignment process is applied to the sheets on the stack tray in this state, the sheet quality could possibly be reduced due to bending of the sheets stacked in a misaligned manner, and due to sliding of the bottom surfaces of the alignment members against the sheets stacked in a misaligned manner.

SUMMARY OF THE INVENTION

The present invention has been made in view of the above problem. The present invention provides a technique to apply an alignment process to sheets stacked on a stack tray in a sheet processing apparatus without reducing the sheet quality.

According to one aspect of the present invention, there is provided a sheet processing apparatus comprising: a stacking control unit configured to control to stack sheets on a stack tray; an alignment unit configured to align sheets stacked on the stack tray; a determination unit configured to determine whether or not a part of sheets stacked on the stack tray has been removed from the stack tray; and a control unit configured to inhibit alignment by the alignment unit in a case where the determination unit determines that a part of sheets stacked on the stack tray has been removed from the stack tray.

According to another aspect of the present invention, there is provided a sheet processing apparatus comprising: a stacking control unit configured to control to stack sheets on a stack tray; an alignment unit configured to align sheets stacked on the stack tray; and a control unit configured to inhibit a process for alignment by the alignment unit, wherein when all of sheets stacked on the stack tray have been removed from the stack tray, the control unit cancels inhibition of the alignment.

According to still another aspect of the present invention, there is provided a control method for a sheet processing apparatus that includes a stacking control unit configured to control to stack sheets on a stack tray and an alignment unit configured to align sheets stacked on the stack tray, the control method comprising steps of: determining whether or not a part of sheets stacked on the stack tray has been removed from the stack tray; and inhibiting alignment by the alignment unit in a case where it has been determined that a part of sheets stacked on the stack tray has been removed from the stack tray.

According to yet another aspect of the present invention, there is provided a computer-readable storage medium storing a program for causing a computer to execute steps of a control method for a sheet processing apparatus that includes a stacking control unit configured to control to stack sheets on a stack tray and an alignment unit configured to align sheets stacked on the stack tray, the control method comprising steps of: determining whether or not a part of sheets stacked on the stack tray has been removed from the stack tray; and inhibiting alignment by the alignment unit in a case where it has been determined that a part of sheets stacked on the stack tray has been removed from the stack tray.

According to the present invention, a technique can be provided that applies an alignment process to sheets stacked on a stack tray without reducing the sheet quality.

Further features of the present invention will become apparent from the following description of exemplary embodiments (with reference to the attached drawings).

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

<Overall Configuration>

Figure 1:
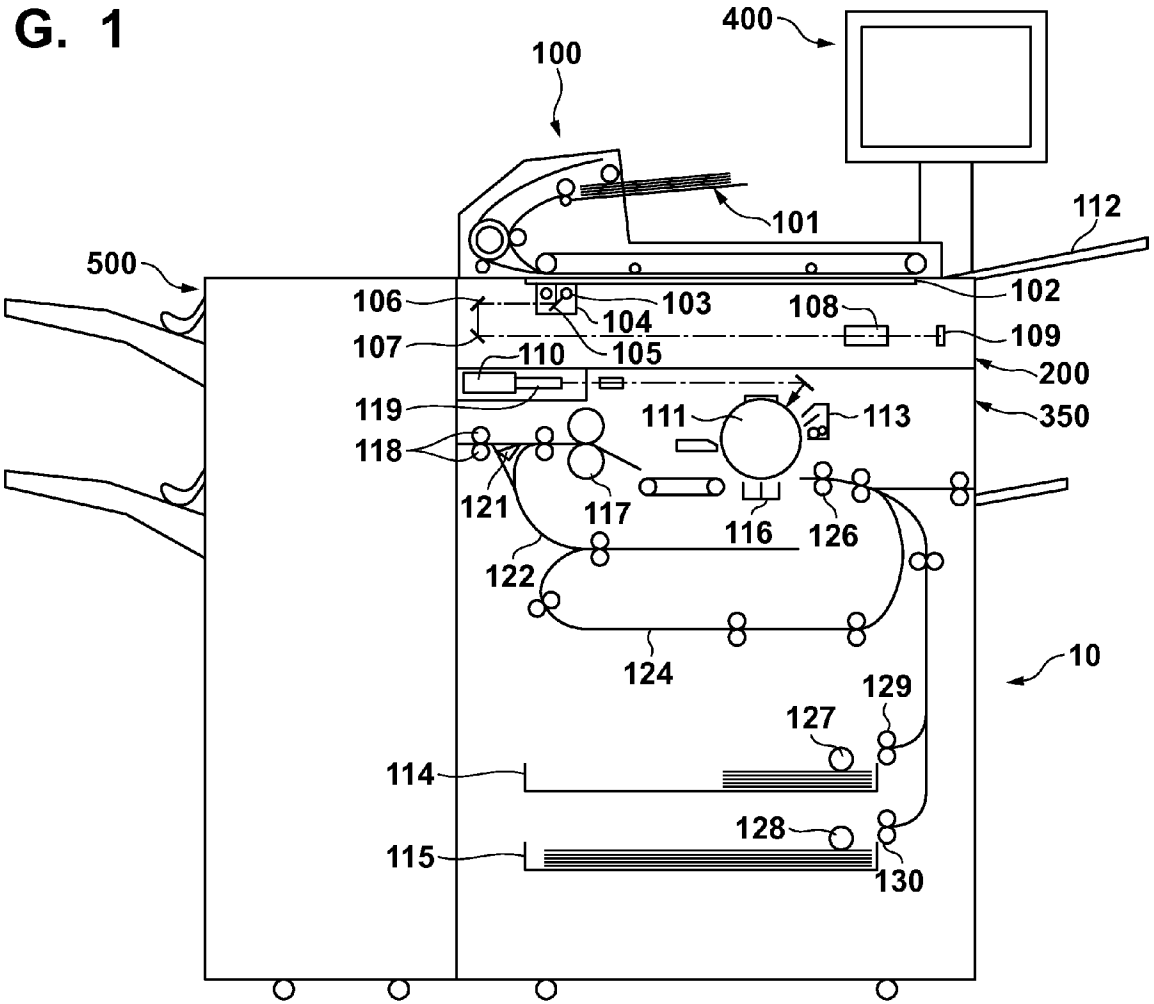
FIG. 1 is a configuration diagram showing cross-sectional configurations of main parts of an image forming system according to embodiments.

FIG. 1 is a configuration diagram showing a cross-sectional configuration of main parts of an image forming system according to embodiments of the present invention.

This image forming system includes an image forming apparatus 10 and a finisher 500 which serves as a sheet stacker. In the image forming system (sheet processing apparatus) described herein, the finisher 500 is connected to the image forming apparatus 10. It should be noted, however, that the present invention is not limited in this way, and is applicable to any sheet processing apparatus with a mechanism to discharge and stack sheets. That is to say, the image forming system, the image forming apparatus and the sheet stacker can each serve as an example of the sheet processing apparatus. The image forming apparatus 10 includes an image reader 200 that reads an image from an original, and a printer 350 that forms (prints) the read image on a sheet.

A document feeder 100 feeds originals set on an original tray 101 one by one in order starting from the top original, conveys the originals along a curved path and past a predetermined pickup position on a glass platen 102, then discharges the originals onto a discharge tray 112. Note that the originals are set on the original tray 101 with their front sides up. At this time, a scanner unit 104 is fixed at a predetermined reading position. When an original passes the reading position, an image of the original is read by the scanner unit 104. When the original passes the reading position, the original is irradiated with light from a lamp 103 in the scanner unit 104, and reflected light from the original is directed to a lens 108 via mirrors 105, 106 and 107. Light that has passed through this lens 108 is focused on an imaging surface of an image sensor 109, converted into image data, and output. The image data output from the image sensor 109 is input as a video signal to an exposure unit 110 in the printer 350.

The exposure unit 110 in the printer 350 outputs laser light that has been modulated based on a video signal input from the image reader 200. A photosensitive drum 111 is irradiated with and scanned by this laser light using a polygon mirror 119. An electrostatic latent image corresponding to the laser light that has scanned the photosensitive drum 111 is formed on the photosensitive drum 111. This electrostatic latent image on the photosensitive drum 111 turns into a visible image by being developed using the developer supplied from a developer 113.

Sheets used in the printing are picked up one by one from a sheet feeding tray 114 or 115, which is provided in the printer 350, by rotation of a pickup roller 127 or 128. The sheets thus picked up are conveyed to the position of registration rollers 126 by rotation of sheet feeding rollers 129 or 130. Although FIG. 1 shows only two sheet feeding trays for the sake of explanation, the printer 350 may include other sheet feeding trays that are not shown in the figures. Furthermore, additional sheet feeding trays may be provided by connecting an optional sheet feeding apparatus not shown in the figures to the printer 350. When the leading edge of a sheet arrives at the position of the registration rollers 126, the registration rollers 126 are driven and rotated at a predetermined timing so as to convey the sheet between the photosensitive drum 111 and a transfer unit 116. Accordingly, a developer image formed on the photosensitive drum 111 is transferred to the fed sheet by the transfer unit 116. The sheet to which the developer image has been thus transferred is conveyed to a fixing unit 117. The fixing unit 117 fixes the image on the sheet by applying heat and pressure to the sheet. The sheet that has passed the fixing unit 117 is discharged to the outside of the printer 350 (to the finisher 500) via a flapper 121 and discharge rollers 118. In the case where images are formed on both sides of the sheet, the sheet is conveyed to a double-sided conveying path 124 via a reversing path 122, then conveyed to the position of the registration rollers 126 again.

<Controller>

Figure 2:
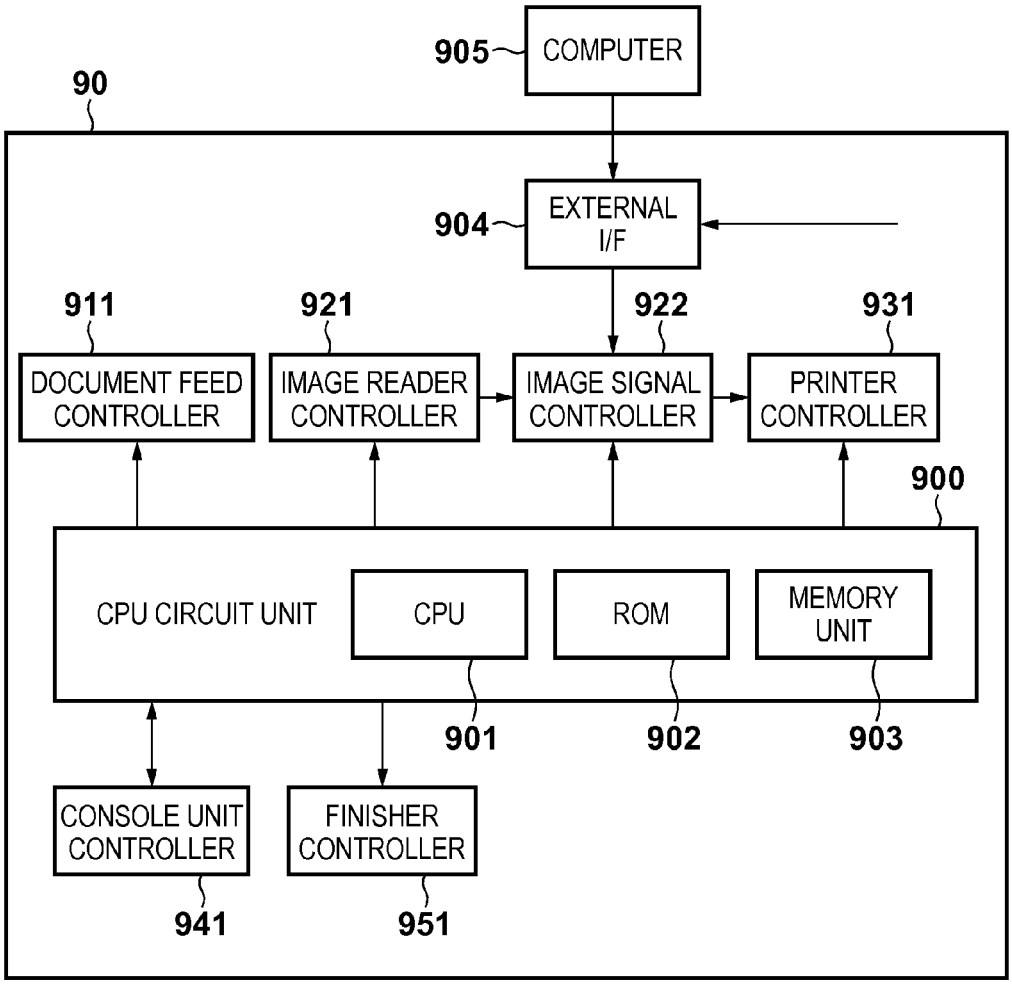
FIG. 2 is a block diagram showing a configuration of a controller that controls the entirety of the image forming system according to embodiments.

The following describes a configuration of a controller unit 90 that controls the entirety of the present image forming system with reference to FIG. 2.

As shown in FIG. 2, the controller unit 90 includes a CPU circuit unit 900 in which a CPU 901, a ROM 902 and a memory unit 903 are built. The memory unit 903 is constituted by a RAM or an HDD. The CPU 901 performs basic control of the entirety of the present image forming system, and is connected to the ROM 902 in which control programs are written and to the memory unit 903 used for processing via an address bus and a data bus. The CPU 901 also performs overall control of controllers 911, 921, 922, 931, 941 and 951 based on the control programs stored in the ROM 902. The memory unit 903 temporarily holds control data and is used as a working area for calculation processing associated with control.

An document feed controller 911 controls driving of the document feeder 100 based on instructions from the CPU circuit unit 900. An image reader controller 921 controls driving of the above-described scanner unit 104, image sensor 109, and the like, and transfers an image signal output from the image sensor 109 to an image signal controller 922. The image signal controller 922 converts an analog image signal from the image sensor 109 into a digital signal, applies various types of processing to the digital signal, converts the digital signal into a video signal, and outputs the video signal to a printer controller 931. The image signal controller 922 also converts a digital image signal input from a computer 905 via an external I/F 904 into a video signal by applying various types of processing to the digital image signal, and outputs the video signal to the printer controller 931. The operations of processing executed by this image signal controller 922 are controlled by the CPU circuit unit 900.

The printer controller 931 controls the exposure unit 110 and the printer 350 based on an input video signal so as to form images and convey sheets. A finisher controller 951 is mounted on the finisher 500, and controls driving of the entirety of the finisher 500 by exchanging information with the CPU circuit unit 900. The details of this control will be described later. A console unit controller 941 exchanges information with an operation display unit 400 and the CPU circuit unit 900. The operation display unit 400 includes, for example, a plurality of keys for setting various types of functions related to image formation, and a display unit for displaying information showing the states of settings. The console unit controller 941 outputs key signals corresponding to operations applied to the keys to the CPU circuit unit 900, and displays corresponding information on the operation display unit 400 based on signals from the CPU circuit unit 900.

<Operation Display Unit>

Figure 3:
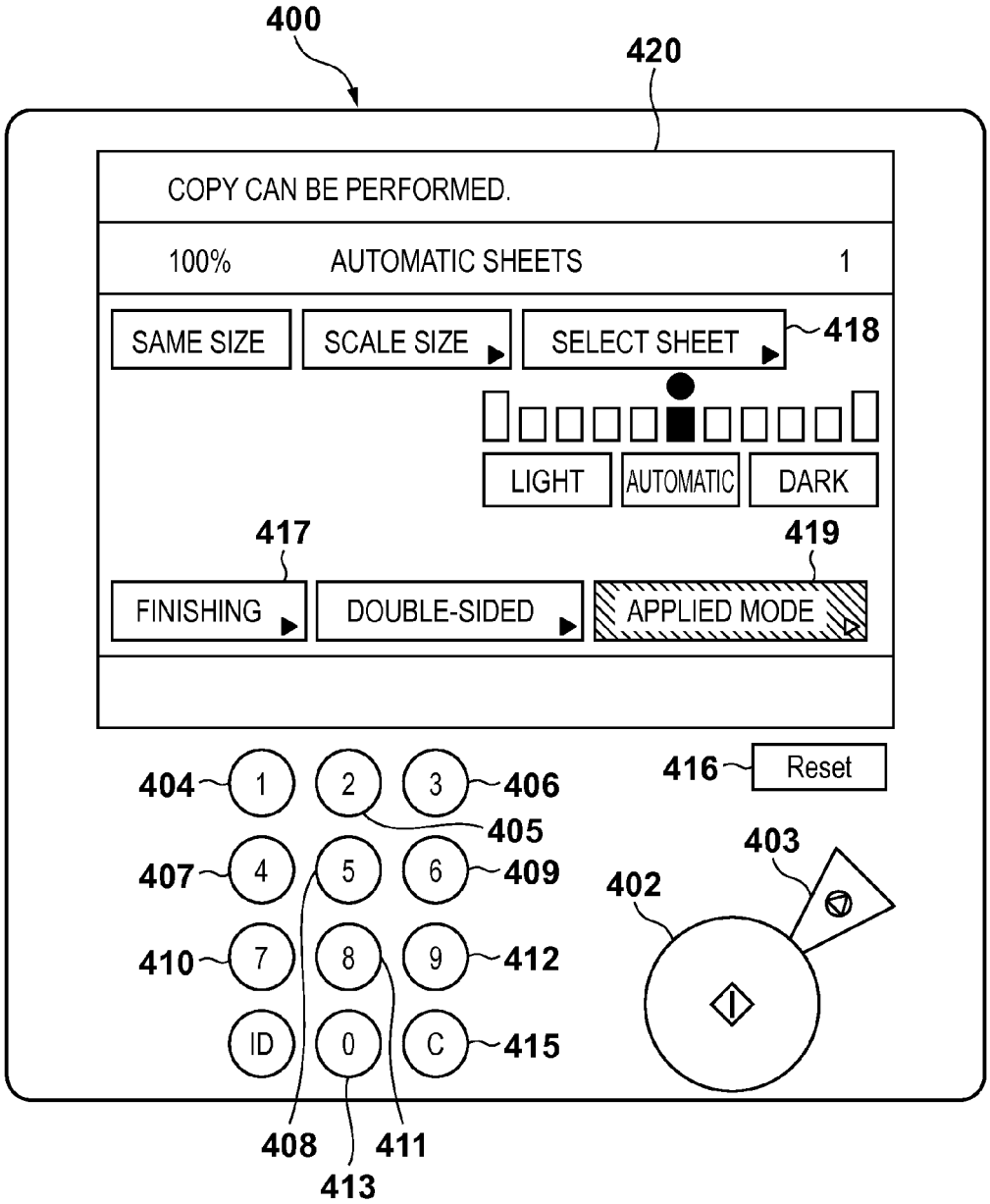
FIG. 3 is a diagram for describing an operation display unit 400 in an image forming apparatus according to embodiments.

FIG. 3 is a diagram for describing the operation display unit 400 in the image forming apparatus 10 according to embodiments of the present invention.

For example, a start key 402, a stop key 403, numeric keys 404 to 413, a clear key 415, and a reset key 416 are arranged on the operation display unit 400. The start key 402 is used to start the image forming operations. The stop key 403 is used to interrupt the image forming operations. The numeric keys 404 to 413 are used to, for example, enter numbers. A display unit 420 is also arranged on the operation display unit 400. A touchscreen is formed on the upper part of the display unit 420. Software keys can be generated on a screen of the display unit 420.

This image forming apparatus 10 includes various process modes as post-process modes, including no sort, sort, shift-sort, staple-sort, and the like. The settings and the like for these process modes are input from the operation display unit 400. For example, a post-process mode is set as follows. When a "Finish" software key 417 is selected on a default screen shown in FIG. 3, a menu selection screen is displayed on the display unit 420. On this menu selection screen, a post-process mode is set.

<Finisher>

Figure 4B:
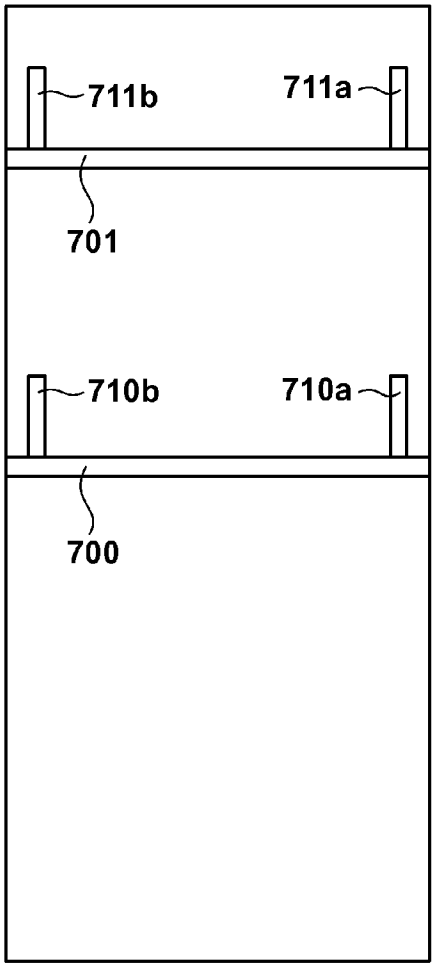
FIG. 4B shows the finisher according to embodiments as viewed in a direction opposing a sheet discharge direction.
Figure 4A:
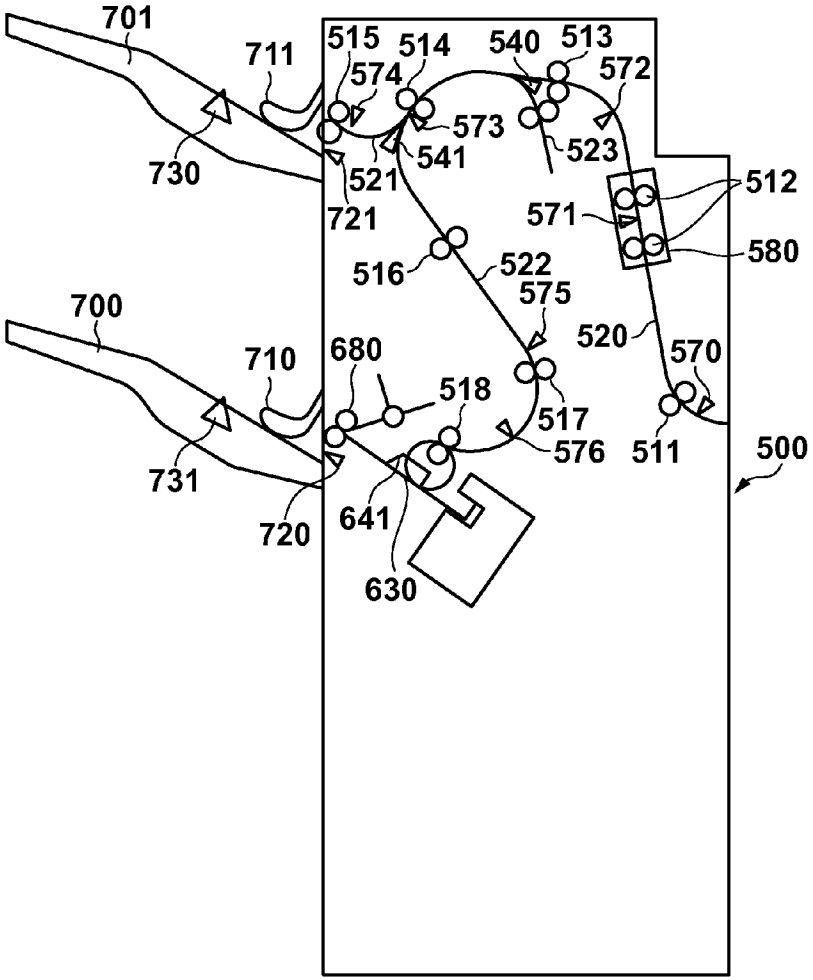
FIG. 4A is a front view of a finisher according to embodiments.

The following describes a configuration of the finisher 500 with reference to FIGS. 4A and 4B. FIGS. 4A and 4B are diagrams for describing a configuration of the finisher 500 according to embodiments of the present invention. FIG. 4A shows the finisher 500 as viewed from the front, and FIG. 4B shows stack trays 700 and 701 in the finisher 500 as viewed in a direction opposing a sheet discharge direction.

First, a process in which the finisher 500 receives sheets discharged from the image forming apparatus 10 and discharges them onto the stack tray 700 or 701 will be described with reference to FIG. 4A.

The finisher 500 receives sheets discharged from the image forming apparatus 10 in order, and executes post-processes such as a process for aligning the plurality of received sheets in a bundle, and a staple process for binding the trailing edges of the bundle of sheets using a stapler. The finisher 500 receives a sheet discharged from the image forming apparatus 10 along a conveyance path 520 using a pair of conveyance rollers 511. The sheet that has been received using the pair of conveyance rollers 511 is conveyed via pairs of conveyance rollers 512, 513 and 514. Sheet sensors 570, 571, 572 and 573 are provided on the conveyance path 520 to detect passing of the sheet. The pair of conveyance rollers 512 is provided in a shift unit 580 together with the sheet sensor 571.

Figure 5:
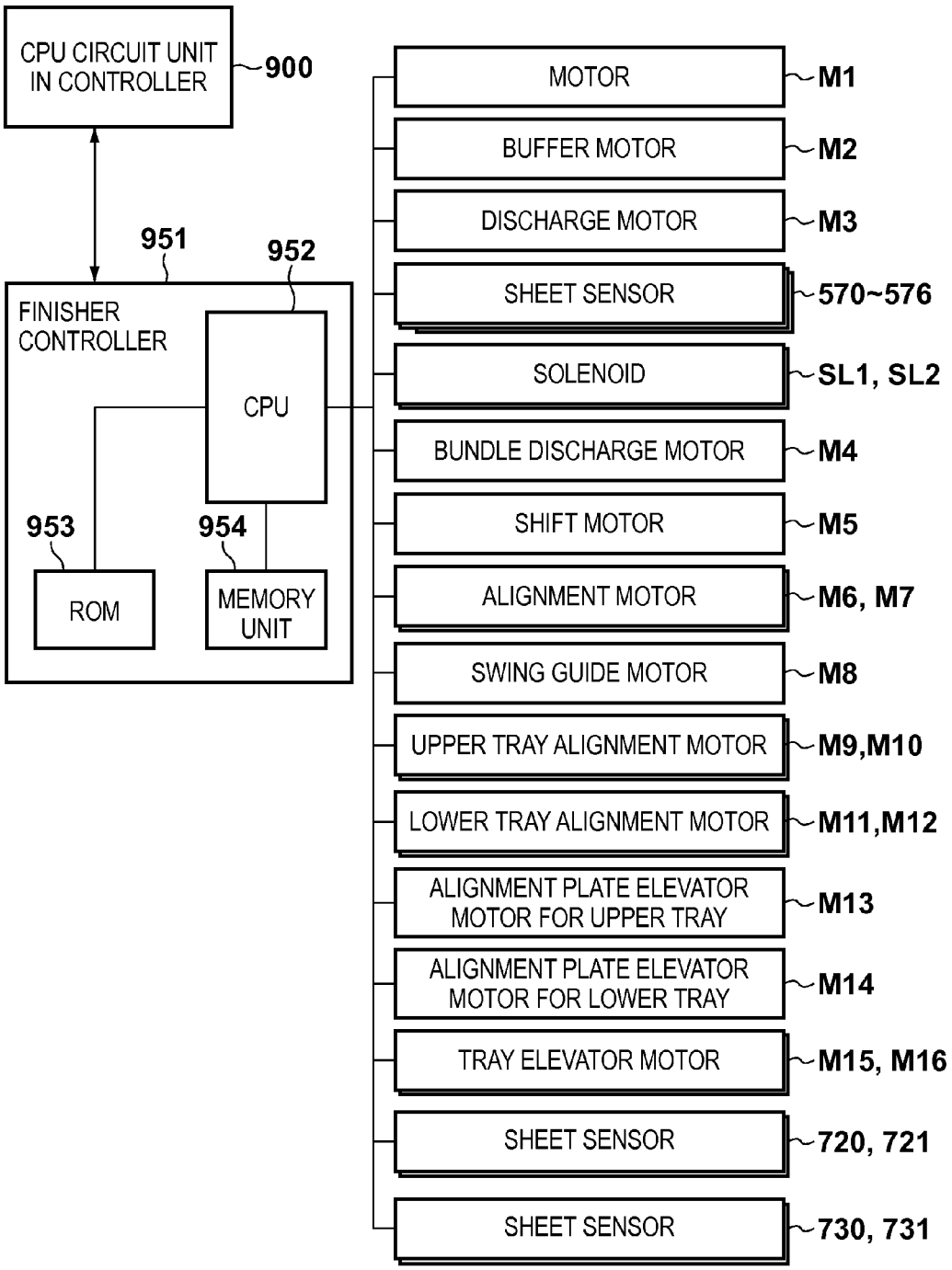
FIG. 5 is a block diagram showing a configuration of a finisher controller according to embodiments.

The shift unit 580 can move the sheet in a sheet width direction orthogonal to a sheet conveyance direction using a later-described shift motor M5 (FIG. 5). By driving the shift motor M5 while the pair of conveyance rollers 512 is holding the sheet therebetween, the sheet can be offset in the width direction while being conveyed. In a shift-sort mode, the position of a bundle of sheets is moved in the width direction on a per-copy basis. For example, an offset amount of 15 mm toward the front (front shift), or an offset amount of 15 mm toward the back (back shift), is set with respect to the center position in the width direction. When no designation is made regarding the shift, sheets are discharged at the same position as in the front shift.

When the finisher 500 detects that a sheet has passed the shift unit 580 based on the input from the sheet sensor 571, the finisher 500 drives the shift motor M5 (FIG. 5) to place the shift unit 580 back to the center position. A switching flapper 540, which directs a sheet conveyed in a reverse fashion by the pair of conveyance rollers 514 to a buffer path 523, is arranged between the pair of conveyance rollers 513 and the pair of conveyance rollers 514. The switching flapper 540 is driven by a later-described solenoid SL1 (FIG. 5).

A flapper 541, which switches between an upper discharge path 521 and a lower discharge path 522, is arranged between the pair of conveyance rollers 514 and the pair of conveyance rollers 515. The flapper 541 is driven by the later-described solenoid SL1. When the flapper 541 switches to the upper discharge path 521, a sheet is directed to the upper discharge path 521 by the pair of conveyance rollers 514 which is driven and rotated by a buffer motor M2 (FIG. 5). Then, the sheet is discharged onto the stack tray (discharge tray) 701 by the pair of conveyance rollers 515 which is driven and rotated by a discharge motor M3 (FIG. 5). A sheet sensor 574 is provided on the upper discharge path 521 to detect passing of the sheet. When the flapper 541 switches to the lower discharge path 522, the sheet is directed to the lower discharge path 522 by the pair of conveyance rollers 514 which is driven and rotated by the buffer motor M2. This sheet is further directed to a process tray 630 by pairs of conveyance rollers 516 to 518 which are driven and rotated by the discharge motor M3. Sheet sensors 575 and 576 are provided on the lower discharge path 522 to detect passing of the sheet. The sheet that has been directed to the process tray 630 is discharged onto the process tray 630 or the stack tray 700, in accordance with a post-process mode, by a pair of bundle discharge rollers 680 driven and rotated by a bundle discharge motor M4 (FIG. 5).

Figure 6A:
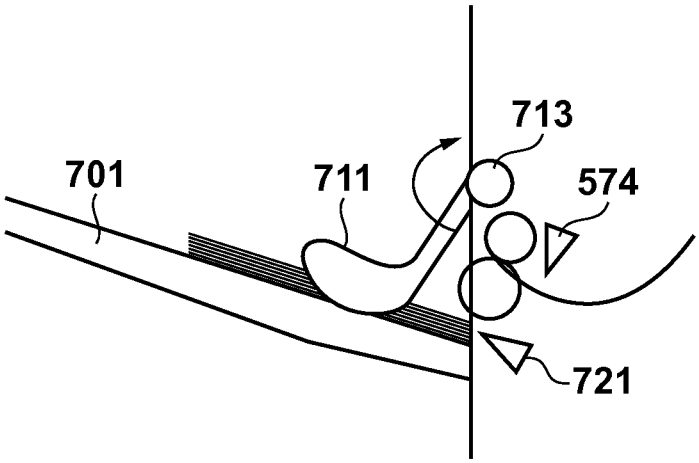
FIG. 6A shows the state of alignment plates when aligning sheets on a stack tray.
Figure 6B:
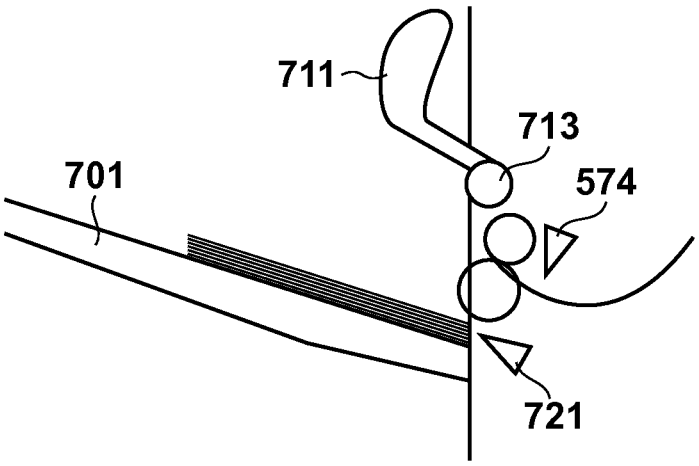
FIG. 6B shows the state where the alignment plates have been retracted from the stack tray.

Next, an alignment mechanism that aligns a plurality of sheets discharged on the stack tray 700 or 701 will be described with reference to FIGS. 4A and 4B. As shown in FIG. 4B, alignment plates 711*a* and 711*b* that are alignment members for aligning sheets discharged onto the stack tray 701 in the sheet width direction by coming into contact with both side edges (side surfaces parallel to the sheet conveyance direction) of the sheets are arranged on the stack tray 701. The alignment plate 711*a* is an example of a first alignment member and the alignment plate 711*b* is an example of a second alignment member. These alignment plates 711*a* and 711*b* are represented by a reference sign 711 in FIG. 4A. Similarly, alignment plates 710*a* and 710*b* are arranged on the stack tray 700. The alignment plates 710*a* and 710*b* are used to align sheets discharged onto the stack tray 700 in the sheet width direction. The alignment plates 710*a* and 710*b*, which are represented by a reference sign 710 in FIG. 4A, can be moved in the sheet width direction respectively by later-described lower tray alignment motors M11 and M12 (FIG. 5). In FIG. 4A, the alignment plates 710*a* and 710*b* are arranged respectively in the front and the back. On the other hand, the alignment plates 711*a* and 711*b* are similarly driven respectively by later-described upper tray alignment motors M9 and M10 (FIG. 5). In FIG. 4A, the alignment plates 711*a* and 711*b* are arranged respectively in the front and the back. Furthermore, the alignment plates 710 and 711 are moved up and down respectively by an alignment plate elevator motor M13 for an upper tray (FIG. 5) and an alignment plate elevator motor M14 for a lower tray (FIG. 5), which will be described later. More specifically, the alignment plates 710 and 711 are moved up and down about an alignment plate axis 713 between aligning positions where they actually execute an alignment process (FIG. 6A) and waiting positions where they wait (FIG. 6B).

The stack trays 700 and 701 can be raised and lowered by later-described tray elevator motors M15 and M16 (FIG. 5). A tray or the topmost surface of sheets on the tray is detected by later-described sheet sensors 720 and 721 (FIG. 4A). The finisher 500 performs control so that the tray or the topmost surface of sheets on the tray is always located at a certain position by driving and rotating the tray elevator motors M15 and M16 in accordance with the input from the sheet sensors 720 and 721, as described later. Furthermore, sheet sensors 730 and 731 (FIG. 4A) detect whether or not there is any sheet on the stack trays 701 and 700.

<Finisher Controller>

A description is now given of a configuration of the finisher controller 951 that controls driving of the finisher 500 with reference to FIG. 5. FIG. 5 is a block diagram showing a configuration of the finisher controller 951 according to embodiments of the present invention.

The finisher controller 951 includes a CPU 952, a ROM 953, a memory unit 954, and the like. The memory unit 954 may be constituted by a RAM, but may include an HDD. The finisher controller 951 controls driving of the finisher 500 by communicating with the CPU circuit unit 900 so as to perform exchange of data such as transmission/reception of commands, exchange of job information, and notification of sheet transfer, and executing various types of programs stored in the ROM 953.

In order to convey sheets, the finisher 500 includes an entrance motor M1 that drives and rotates the pairs of conveyance rollers 511 to 513, a buffer motor M2, a discharge motor M3, a shift motor M5, solenoids SL1 and SL2, and sheet sensors 570 to 576. The finisher 500 also includes, as means to drive various types of members in the process tray 630 (FIG. 4A), a bundle discharge motor M4 that drives the pair of bundle discharge rollers 680, and alignment motors M6 and M7 that drive alignment members 641 (FIG. 4A). The finisher 500 further includes a swing guide motor M8 that drives a swing guide to be raised and lowered. The finisher 500 further includes tray elevator motors M15 and M16 for raising and lowering the stack trays 700 and 701, sheet sensors 720 and 721 (FIG. 4A), and sheet sensors 730 and 731. In relation to alignment operations for sheets on the stack trays, the finisher 500 further includes upper tray alignment motors M9 and M10, lower tray alignment motors M11 and M12, an alignment plate elevator motor M13 for the upper tray, and an alignment plate elevator motor M14 for the lower tray.

<Sheet Detection>

Figure 12:
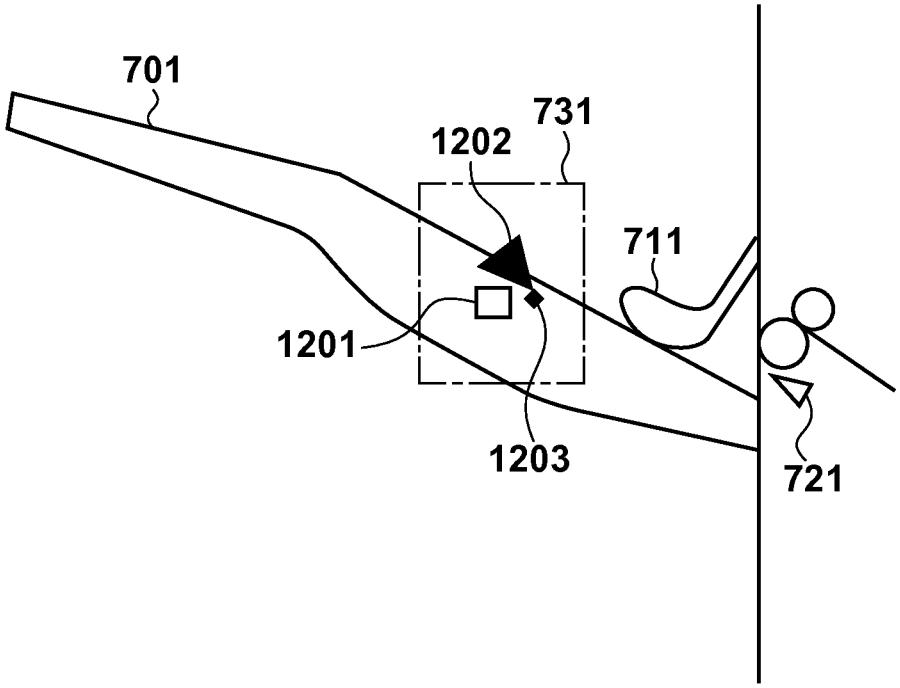
FIG. 12 shows a configuration of a sheet sensor according to embodiments.
Figure 13A:
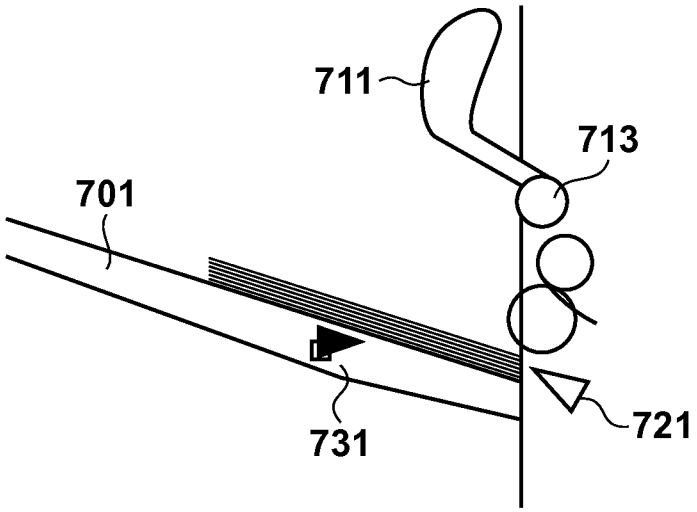
FIGS. 13A and 13B show positional relationships between the sheet sensor and the stack tray when detecting sheets on the stack tray using the sheet sensor according to embodiments.
Figure 13B:
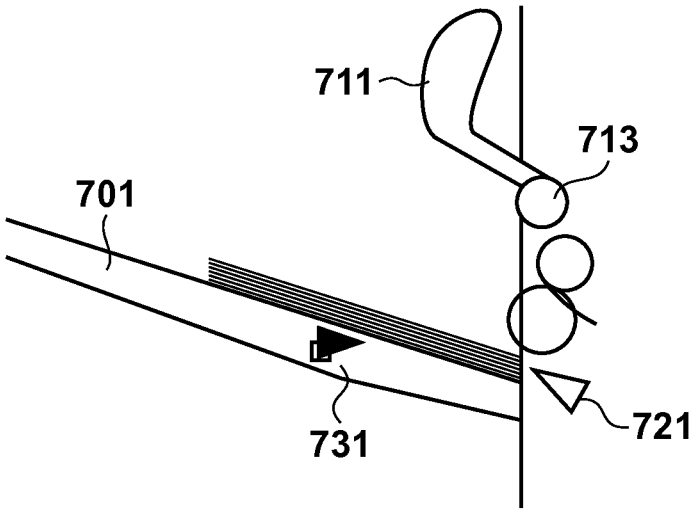

The following describes sheet detection performed in the image forming apparatus 10 according to embodiments of the present invention with reference to FIGS. 12, 13A and 13B. Sheet detection denotes detection of the presence and absence of sheets stacked on the stack trays 700 and 701, and detection of removal of (a part of) sheets stacked on the stack trays 700 and 701 (that is to say, a decrease in stacked sheets).

First, a description is given of a mechanism for detecting the presence and absence of sheets discharged and stacked on the stack trays 700 and 701 using the sheet sensors 730 and 731 with reference to FIG. 12. FIG. 12 is an enlarged view of the stack tray 701. Although the sheet sensor 731 arranged on the stack tray 701 will be described in the following example, the same goes for the sheet sensor 730 arranged on the stack tray 700.

A portion indicated by a chain line in FIG. 12 corresponds to the sheet sensor 731 arranged on a central portion of the stack tray 701. The sheet sensor 731 is composed of a detection sensor 1201 utilizing a photo interrupter, a light-blocking plate 1202, and a rotation axis 1203 of the light-blocking plate 1202. When sheets are discharged onto the stack tray 701, these sheets apply a load to the light-blocking plate 1202 in a direction toward the inside of the stack tray 701. Consequently, the light-blocking plate 1202 rotates toward the inside of the stack tray 701 about the rotation axis 1203, which serves as a spindle, and moves to a position where it blocks light from a light emitting unit to a light receiving unit in the detection sensor 1201.

When the light from the light emitting unit to the light receiving unit in the detection sensor 1201 is blocked by the light-blocking plate 1202 (a blocked state), the detection sensor 1201 notifies the CPU 952 in the finisher controller 951 of information indicating the presence of sheets on the stack tray 701. On the other hand, when the light from the light emitting unit to the light receiving unit in the detection sensor 1201 is not blocked (a transmissive state), the detection sensor 1201 notifies the CPU 952 of information indicating the absence of sheets on the stack tray 701. Based on the information notified by the detection sensor 1201, the CPU 952 notifies the CPU circuit unit 900 of the presence or absence of sheets on the stack tray 701.

With reference to FIGS. 13A and 13B, the following describes a mechanism for detecting the removal of a part of sheets stacked on the stack trays 700 and 701 using the sheet sensors 720 and 721. Although the stack tray 701, the sheet sensor 721 and the tray elevator motor M16 will be described in the following example, the same goes for the stack tray 700, the sheet sensor 720 and the tray elevator motor M15.

The CPU 952 in the finisher controller 951 performs control such that, while sheets are being stacked on the stack tray 701, the stack tray 701 is located at a position (height) where the sheet sensor 721 can detect the topmost sheet out of the stacked sheets. Alternatively, the CPU 952 may perform control such that, while sheets are being stacked on the stack tray 701, the stack tray 701 is located at a position (height) where the sheet sensor 721 can detect at least an upper part of the stacked sheets adjacent to the topmost sheet. The CPU 952 raises and lowers the stack tray 701 as follows in accordance with a signal output from the sheet sensor 721 by controlling the tray elevator motor M16.

The sheet sensor 721, which utilizes a photo interrupter, detects sheets based on the transmissive/blocked state between a light emitting unit and a light receiving unit in the photo interrupter, and outputs a signal indicating the transmissive/blocked state to the CPU 952. When the sheet sensor 721 is placed in the blocked state, the CPU 952 lowers the stack tray 701 to a position where the sheet sensor 721 is placed in the transmissive state (FIG. 13A). Thereafter, the CPU 952 raises the stack tray 701, and then stops the raising of the stack tray 701 when the sheet sensor 721 is placed in the blocked state (FIG. 13B). In this way, on the stack tray 701, the topmost sheet out of the stacked sheets (or an upper part of the stacked sheets) is detected by the sheet sensor 721. Note that the state where the topmost sheet is detected by the sheet sensor 721, as shown in FIG. 13B, is hereinafter referred to as a "sheet surface detection state".

While sheets are being stacked on the stack tray 701, the CPU 952 controls the tray elevator motor M16 (raises and lowers the stack tray 701) so as to maintain the aforementioned sheet surface detection state. Consequently, the topmost sheet out of the stacked sheets remains at a certain position (height). Note that the CPU 952 maintains the sheet surface detection state (FIG. 13B) by, for example, lowering the stack tray 701 each time a certain number sheets have been printed (that is to say, in accordance with the thickness of the stacked sheets) during printing.

In the sheet surface detection state, if at least the topmost sheet out of the stacked sheets (or an upper part of the stacked sheets) is removed, the sheet sensor 721 switches from the blocked state to the transmissive state. In this case, the sheet sensor 721 accordingly outputs a signal indicating the transmissive state to the CPU 952. That is to say, if the sheet sensor 721 detects the disappearance of the topmost sheet (or the upper part of the stacked sheets) that has been detected, it outputs, to the CPU 952, a signal indicating the removal of a part of the sheets stacked on the stack tray 701. When the CPU 952 receives the signal indicating that the sheet sensor 721 has been placed in the transmissive state during the sheet surface detection state, it determines that (a part of) the sheets have been removed from the stack tray 701, and notifies the CPU circuit unit 900 of the removal. Thereafter, in order to restore the sheet surface detection state, the CPU 952 raises the stack tray 701 until the sheet sensor 721 is placed in the blocked state by controlling the tray elevator motor M16.

As described above, according to embodiments of the present invention, the sheet sensors 720 and 721 are examples of a first sensor that detects the removal of a part of sheets stacked on the stack trays 700 and 701. Also, the sheet sensors 730 and 731 are examples of a second sensor that detects the presence and absence of sheets stacked on the stack trays 700 and 701. Furthermore, the amount of sheets stacked on the stack trays 700 and 701 can be detected using the sheet sensors 720 and 721. For example, the CPU 952 can obtain the amount of stacked sheets based on a difference between: the position (height) of the stack tray 700 or 701 during the sheet surface detection state, which corresponds to the position of the topmost sheet; and the position (height) where the sheet sensor 720 or 721 is situated.

<Sort Operations>

Figure 10A:
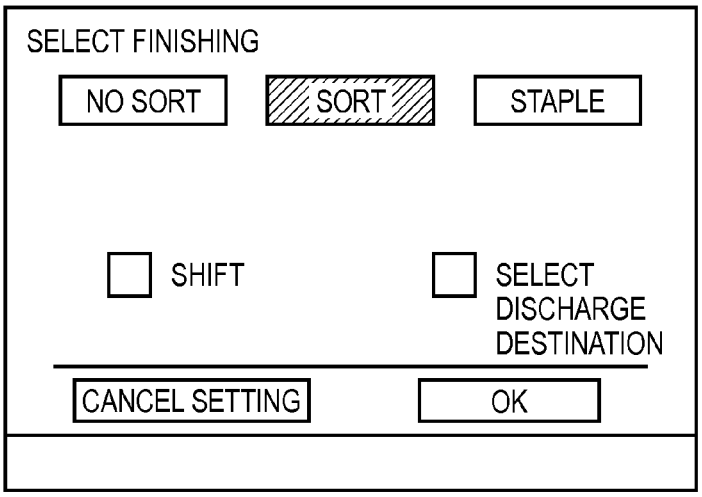
FIGS. 10A and 10B show examples of a finishing mode selection screen displayed on the operation display unit in the image forming apparatus according to embodiments.
Figure 10B:
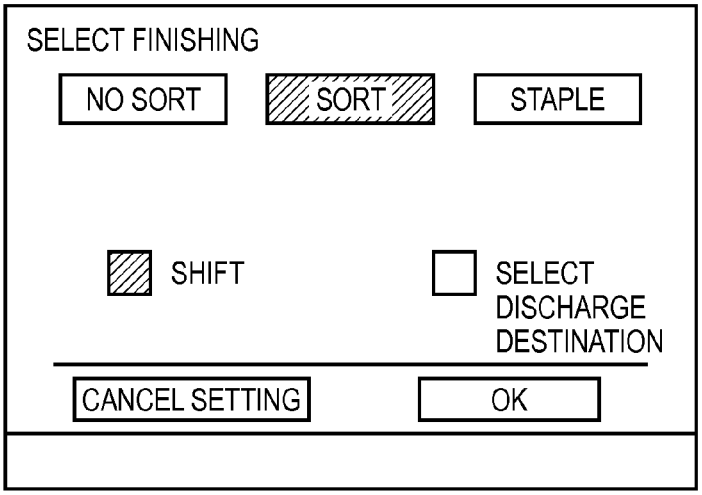
Figure 10C:
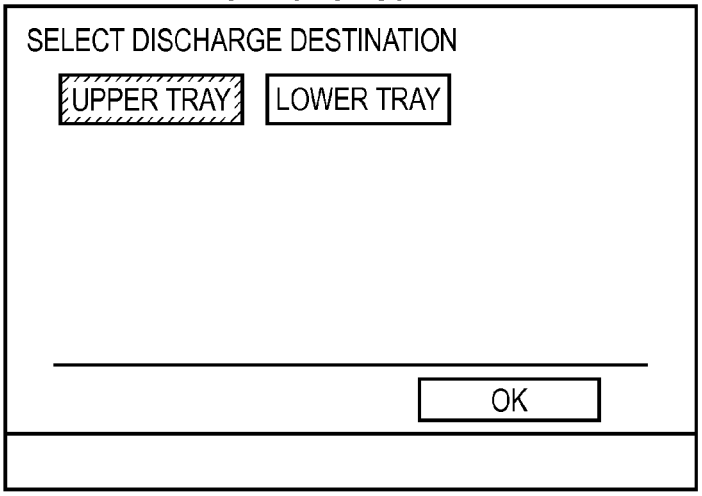
FIG. 10C shows an example of a discharge destination selection screen displayed on the operation display unit in the image forming apparatus according to embodiments.
Figure 11:
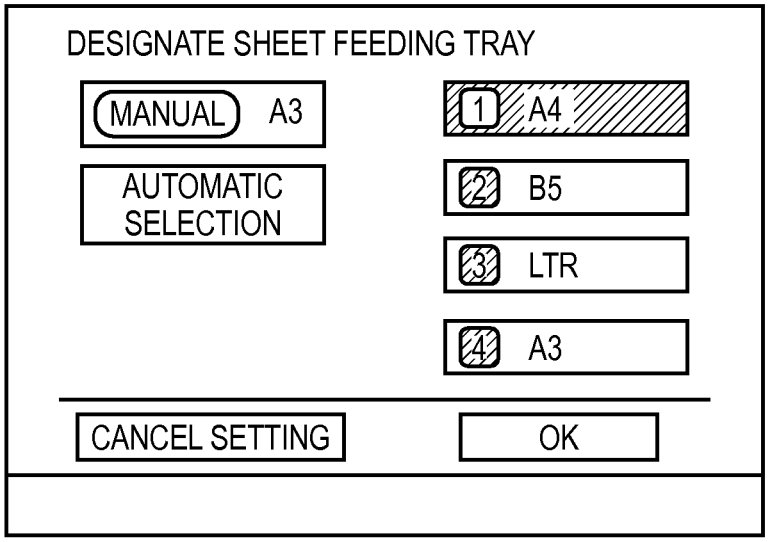
FIG. 11 shows an example of a sheet feeding tray selection screen.

The following describes a flow of sheets during a sort mode with reference to FIGS. 3, 7, 8A to 8D, 10A to 10C, and 11. When the user presses a "Select Sheet" key 418 on the default screen shown in FIG. 3 on the operation display unit 400 of the image forming apparatus 10, a sheet feeding tray selection screen as shown in FIG. 11 is displayed on the display unit 420. On this sheet feeding tray selection screen, the user selects sheets to be used for a job. It is assumed here that the user selects the size "A4" corresponding to a sheet feeding tray 1. FIG. 11 shows one example of the sheet feeding tray selection screen on which the size "A4" is selected.

When the user selects the "Finish" software key 417 on the default screen shown in FIG. 3 on the operation display unit 400 of the image forming apparatus 10, a finish menu selection screen shown in FIG. 10A is displayed on the display unit 420. When the user presses an OK button while a "Sort" key is selected on the finish menu selection screen shown in FIG. 10A, the sort mode is set.

In order to offset a bundle of sheets on a per-copy basis, the user presses the OK button while a "Shift" key is selected on the finish menu selection screen shown in FIG. 10A; as a result, a shift mode is set.

Once the user has designated the sort mode and entered a job, the CPU 901 in the CPU circuit unit 900 notifies the CPU 952 in the finisher controller 951 of information related to that job, such as the sheet size and the selection of the sort mode. Note that after sheets have been discharged in one print job, shift operations are applied to sheets printed in the next print job so that the sheets printed in the next print job are discharged at a different position from the sheets discharged in the previous job. Such shift operations applied for each print job are referred to as an inter-job shift.

Figure 7:
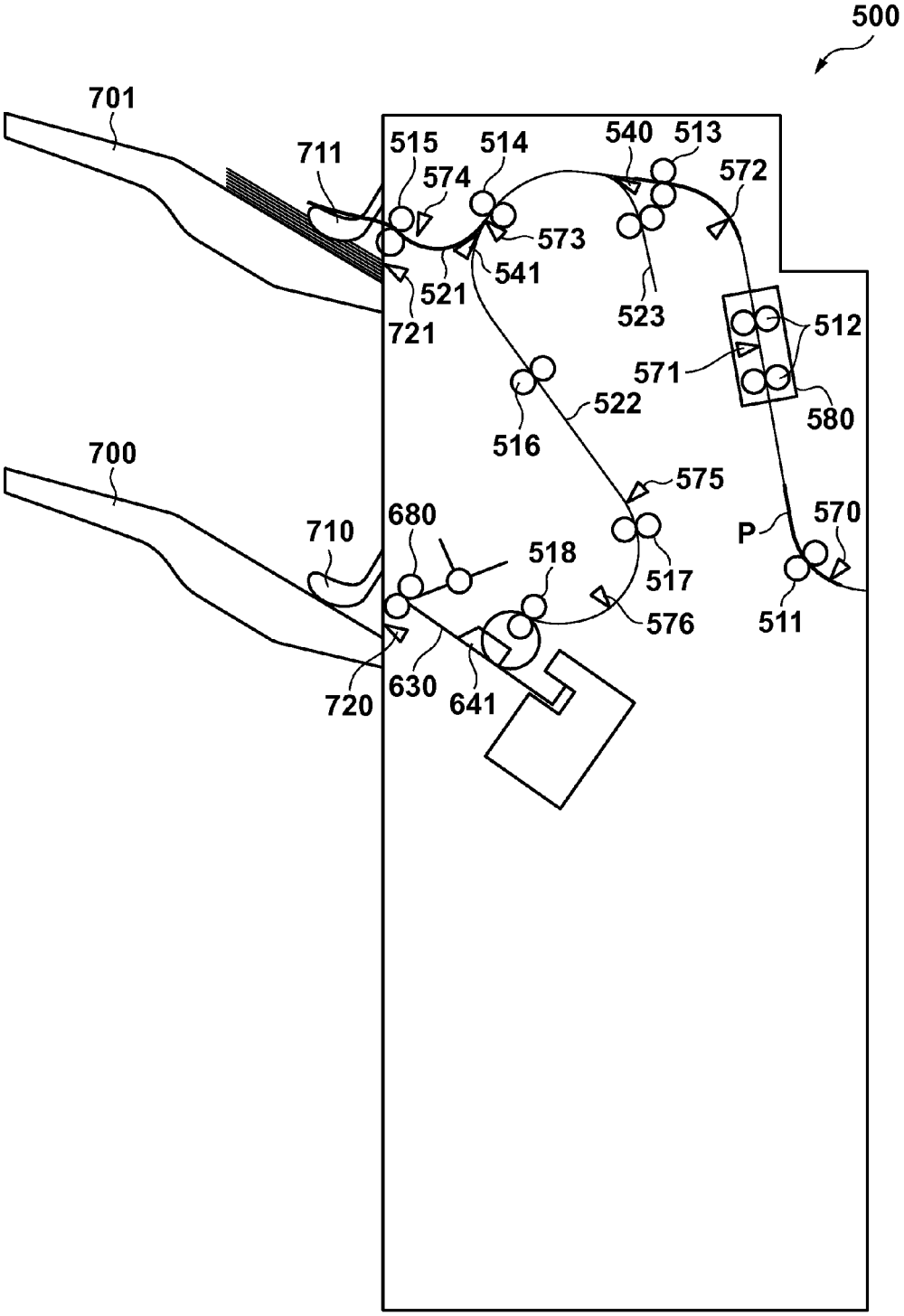
FIG. 7 is a diagram for describing the conveyance of sheets in the finisher according to embodiments.

FIG. 7 is a diagram for describing the conveyance of sheets in the finisher according to embodiments of the present invention, and in FIG. 7, the parts that are shown in the above-described FIG. 4A are given the same reference signs as in FIG. 4A.

When the image forming apparatus 10 discharges a sheet P to the finisher 500, the CPU 901 in the CPU circuit unit 900 notifies the CPU 952 in the finisher controller 951 of the start of sheet transfer. The CPU 901 also notifies the CPU 952 in the finisher controller 951 of sheet information, such as shift information and sheet width information of the sheet P. Upon receiving the notification of the start of sheet transfer, the CPU 952 drives and rotates the entrance motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. The sheet sensor 571 detects the sheet P when the pair of conveyance rollers 512 holds the sheet P therebetween. Accordingly, the CPU 952 offsets the sheet P in the width direction by moving the shift unit 580 through driving of the shift motor M5. When the shift information included in the sheet information notified from the CPU 901 shows "no shift designation", sheets are equally offset by 15 mm toward the front.

When the flapper 541 is driven and rotated by the solenoid SL1 to be situated in the position shown in FIG. 7, the sheet P is directed to the upper discharge path 521. Then, when the sheet sensor 574 detects passing of the trailing edge of the sheet P, the CPU 952 discharges the sheet P onto the stack tray 701 by driving and rotating the discharge motor M3 so that the sheet P is conveyed by the pair of conveyance rollers 515 at a speed suited for stacking.

Next, a description is given of the alignment operations during a sort mode, using an example of the front shift operations, with reference to FIGS. 8A to 8D. FIGS. 8A to 8D are diagrams for describing the positions of the alignment plates 711*a* and 711*b* on the stack tray 701 as viewed in a direction opposing the sheet discharge direction.

Figure 8A:
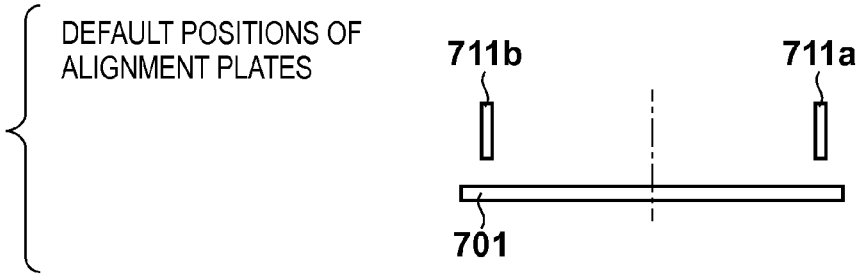
FIGS. 8A to 8D are diagrams for describing alignment operations for sheets on a discharge tray during a sort mode according to embodiments.
Figure 8B:
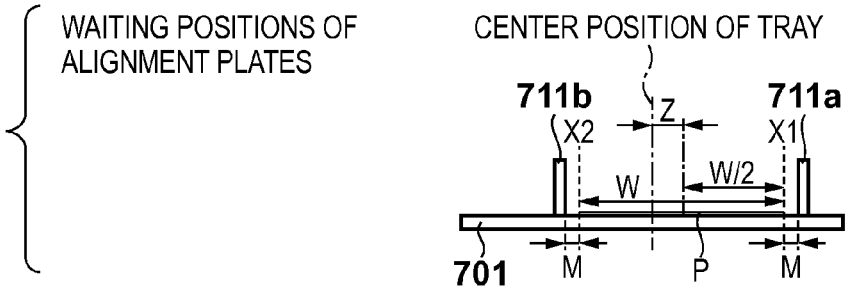
Figure 8C:
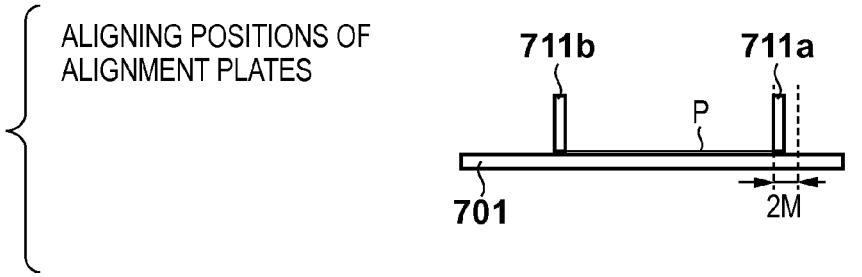
Figure 8D:
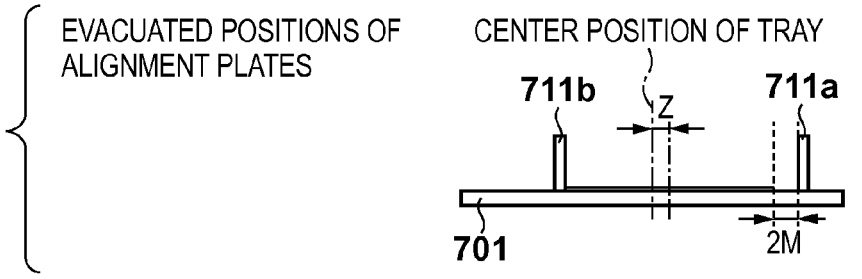

As shown in FIG. 8A, before a job is started, the pair of alignment plates 711*a* and 711*b* waits at default positions. As shown in FIG. 8B, when the job is started, the front alignment plate 711*a* moves to an alignment waiting position that is distant from a front sheet edge position X1 by a predetermined retracted amount M. Note, the front sheet edge position X1 is distant from the center position of the stack tray 701 by a distance obtained by adding a shift amount Z to W/2 which is half of the sheet width. The alignment plate 711*a* waits at this alignment waiting position until a sheet is discharged. On the other hand, the back alignment plate 711*b* waits at an alignment waiting position that is distant from a back sheet edge position X2 by the predetermined retracted amount M. Note, the back sheet edge position X2 is distant from the center position of the stack tray 701 by a distance obtained by subtracting the shift amount Z from W/2 which is half of the sheet width. When a predetermined time period has elapsed since the sheet P was discharged onto the stack tray 701, the front alignment plate 711*a* moves toward the center of the stack tray 701 by a predetermined push amount 2M so as to press the sheet P against the stopped back alignment plate 711*b* as shown in FIG. 8C. As a result, the sheet P is moved toward the alignment plate 711*b* by the retracted amount M. When a predetermined period has elapsed since the sheet P was pressed against the alignment plate 711*b* in the above manner, the alignment plate 711*a* is retracted to the alignment waiting position as shown in FIG. 8D. More specifically, the alignment plate 711*a* is retracted away from the sheet P in the sheet width direction by 2M which is twice the retracted amount M, then waits until the next sheet is discharged onto the stack tray 701. Provided that the offset amount Z is 15 mm and the retracted amount M is 5 mm, the front alignment plate 711*a* pushes the sheet P by 5 mm during the alignment operations, and therefore the offset amount of the sheet P after the alignment operations is 10 mm. By repeating the above operations, a sheet P is aligned each time it is discharged onto the stack tray 701.

<Shift-Sort Operations>

The following describes a flow of sheets during a shift-sort mode with reference to FIGS. 3, 7, 9A to 9G, and 10A to 10C. The shift-sort mode is set when the OK key is pressed while the "Sort" and "Shift" keys are selected on the finish menu selection screen shown in FIG. 10B.

Once the user has designated the shift-sort mode and entered a job, the CPU 901 in the CPU circuit unit 900 notifies the CPU 952 in the finisher controller 951 of the selection of the shift-sort mode, similarly to the case of a no sort mode. The following describes the operations for a shift-sort mode in the case where one "copy" is composed of three sheets.

When the image forming apparatus 10 discharges a sheet P to the finisher 500, the CPU 901 in the CPU circuit unit 900 notifies the CPU 952 in the finisher controller 951 of the start of sheet transfer. Upon receiving the notification of the start of sheet transfer, the CPU 952 drives the entrance motor M1, the buffer motor M2 and the discharge motor M3. As a result, the pairs of conveyance rollers 511, 512, 513, 514 and 515 shown in FIG. 7 are driven and rotated, thus making the finisher 500 receive and transfer the sheet P discharged from the image forming apparatus 10. When the sheet sensor 571 detects that the sheet P is held between the pair of conveyance rollers 512, the CPU 952 offsets the sheet P by moving the shift unit 580 through driving of the shift motor M5. The sheet P is offset by 15 mm toward the front when the shift information of the sheet P notified from the CPU 901 shows "front", and by 15 mm toward the back when the shift information of the sheet P notified from the CPU 901 shows "back".

The flapper 541 is driven and rotated by the solenoid SL1 to be situated in the position shown in the figures, and the sheet P is directed to the upper discharge path 521. When the sheet sensor 574 detects passing of the trailing edge of the sheet P, the CPU 952 discharges the sheet P onto the stack tray 701 by driving the discharge motor M3 so that the pair of conveyance rollers 515 is rotated at a speed suited for stacking.

Figure 9A:
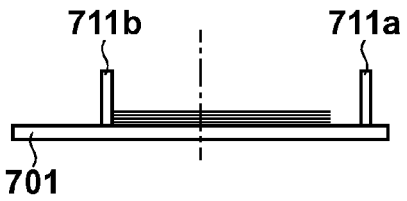
FIGS. 9A to 9G are diagrams for describing alignment operations for sheets on the discharge tray during a shift-sort mode according to embodiments.
Figure 9B:
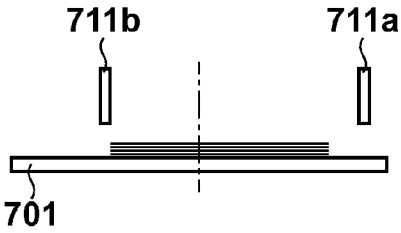
Figure 9C:
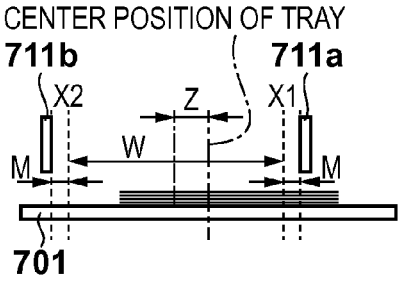
Figure 9D:
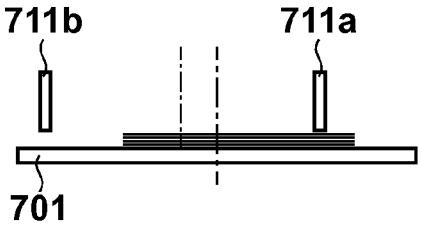

The following describes the operations of the alignment plates at the time of the shifting, using the exemplary case where the shift direction is changed from the front to the back, with reference to FIGS. 9A to 9G. FIGS. 9A to 9G show the stack tray 701 as viewed in a direction opposing the sheet discharge direction. When a retracting operation of the front alignment plate 711*a* is finished as shown in FIG. 9A, the alignment plates 711*a* and 711*b* are raised off the stack tray 701 by a predetermined amount as shown in FIG. 9B. Next, the alignment plates 711*a* and 711*b* move in the sheet width direction to their respective alignment waiting positions for the next sheet. As shown in FIG. 9C, the front alignment plate 711*a* moves to an alignment waiting position that is distant from the front sheet edge position X1 by the predetermined retracted amount M. Note, the front sheet edge position X1 is distant from the center position of the stack tray 701 by a distance obtained by subtracting the shift amount Z from W/2 which is half of the sheet width. The back alignment plate 711*b* moves to an alignment waiting position that is distant from the back sheet edge position X2 by the predetermined retracted amount M. Note, the back sheet edge position X2 is distant from the center position of the stack tray 701 by a distance obtained by adding the shift amount Z to W/2 which is half of the sheet width. Once the alignment plates 711*a* and 711*b* have moved to their respective alignment waiting positions, the alignment plates 711*a* and 711*b* move toward the stack tray 701 by a predetermined amount and wait until the next sheet is discharged onto the stack tray 701 as shown in FIG. 9D. At this time, the alignment plate 711*a* is in contact with the top surface of the already-stacked sheets.

Figure 9E:
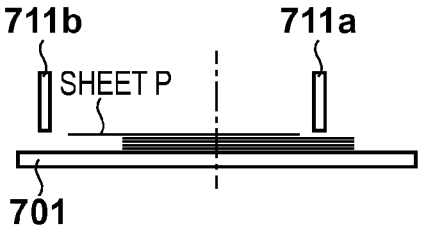
Figure 9F:
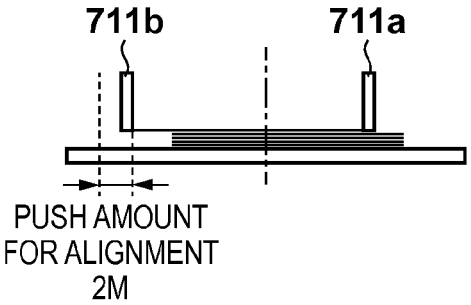
Figure 9G:
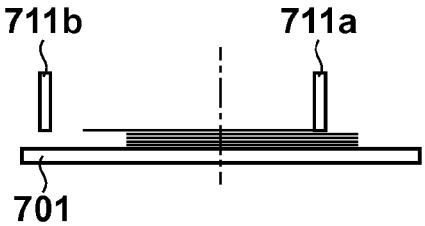

When a predetermined time period has elapsed since a sheet P was discharged onto the stack tray 701 as shown in FIG. 9E, the alignment plate 711*b* moves toward the center of the stack tray 701 by the predetermined push amount 2M so as to press the sheet P against the alignment plate 711*a* as shown in FIG. 9F. When a predetermined time period has elapsed in the state of FIG. 9F, the alignment plate 711*b* is retracted away from the center of the stack tray 701 by the predetermined push amount 2M and waits until the next sheet is discharged onto the stack tray 701 as shown in FIG. 9G.

As described above, when the shift direction is changed, alignment plates are first raised off a stack tray in the upward direction, then lowered after changing the aligning positions; in this way, a sheet is aligned each time it is discharged onto the stack tray.

<Selection of Stack Tray (Discharge Tray)>

When a "Select Discharge Destination" key is selected on the finish menu selection screen shown in FIG. 10A, a discharge destination selection screen shown in FIG. 10C is displayed on the display unit 420. When the user selects a discharge destination and presses the OK key, the discharge destination is selected, and the finishing menu selection screen shown in FIG. 10A is displayed on the display unit 420.

First Embodiment

Problem in Alignment Process

Figure 14A:
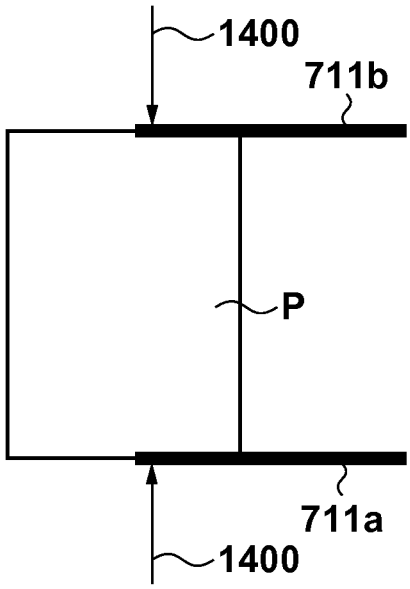
FIGS. 14A and 14B show examples of alignment operations for sheets, respectively in the state where sheets discharged onto the stack tray have not been removed and in the state where a part of the sheets has been removed.

As described above with reference to FIGS. 4A and 4B, the finisher 500 includes alignment plates 710*a*, 710*b*, 711*a* and 711*b* as alignment mechanism for aligning a plurality of sheets discharged onto the stack trays 700 and 701. For example, the finisher 500 uses the pair of alignment plates 711*a* and 711*b* when executing an alignment process for aligning a plurality of sheets P stacked on the stack tray 710 in the width direction. FIG. 14A shows the case where the alignment process is applied to the plurality of sheets P discharged onto the stack tray 701 using the alignment plates 711*a* and 711*b*. The plurality of sheets P are aligned in the width direction, which is indicated by arrows 1400, by the alignment plates 711*a* and 711*b* moving in the width direction and coming into contact with the side edges of the plurality of sheets P at the positions shown in FIG. 14A.

Figure 14B:
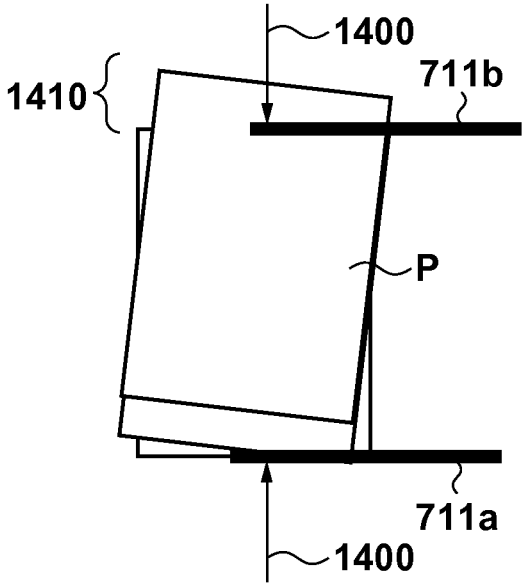

However, if the user removes a part of the plurality of sheets P discharged onto the stack tray 701, the sheets P stacked on the stack tray 701 may be misaligned as shown in FIG. 14B. Should the alignment process be applied to the sheets P in this state, there is a possibility that the sheets may be damaged by the alignment plates 711*a* and 711*b* moving in the directions indicated by the arrows 1400 and coming into contact with the sheets P. For example, there is a possibility that the sheets may be bent by the alignment plates 711*a* and 711*b* when the alignment plates 711*a* and 711*b* come into contact with the misaligned sheets (in particular, the portion indicated by the reference sign 1410). Furthermore, there is a possibility that toner on the sheets may be removed by the bottom surfaces of the alignment plates 711*a* and 711*b* sliding against the surfaces of misaligned sheets. Moreover, if the toner that has attached to the bottom surfaces of the alignment plates 711*a* and 711*b* attaches to other parts of the same sheet or to other sheets, there is a possibility that the quality of sheets (and of images printed on the sheets) may be reduced.

The present embodiment addresses the above problem as follows: if a part of sheets stacked on the stack trays 700 and 701 is removed from these stack trays, an alignment process for the sheets is inhibited. In other words, after a part of the sheets has been removed, an alignment process is not applied to sheets remaining on the stack trays 700 and 701. In this way, bending of sheets and removal of toner are prevented, and the quality of sheets discharged onto the stack trays 700 and 701 is not reduced by an alignment process.

<Control for Alignment Operations>

Figure 15:
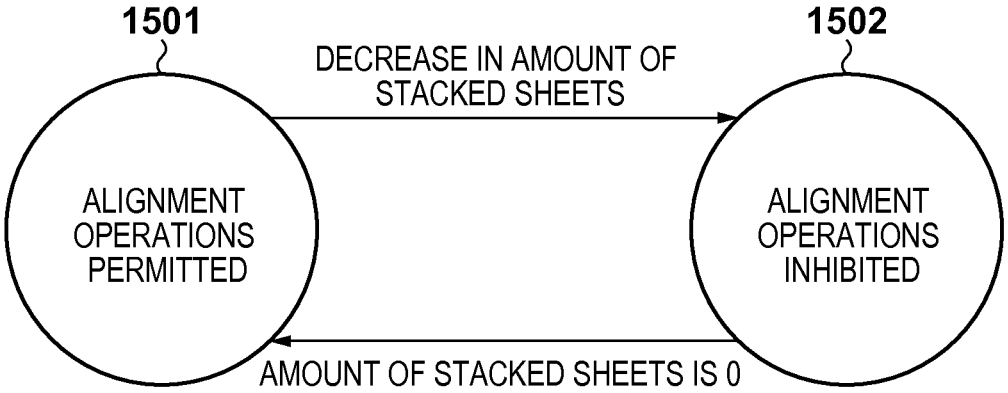
FIG. 15 is a state transition diagram related to operational states of an alignment process according to a first embodiment.

The following is a more specific description of alignment operations for sheets according to a first embodiment with reference to FIG. 15. FIG. 15 is a state transition diagram related to alignment operations for sheets according to the first embodiment. In the present embodiment, the CPU 952 in the finisher controller 951 switches the state of alignment operations for sheets that have been discharged and stacked on the stack trays 700 and 701 based on information from the sheet sensors 720 and 721 and from the sheet sensors 730 and 731. Note that the CPU 952 controls alignment operations for sheets for each of the stack trays 700 and 701 independently. Since the control for the alignment operations is the same for both of the stack trays 700 and 701, the stack tray 701 will be discussed below.

When the sheet sensor 731 detects no sheet on the stack tray 701, the CPU 952 controls the lower tray alignment motors M11 and M12 and the alignment plate elevator motor M14 for the lower tray such that alignment operations are applied to sheets that are to be discharged onto the stack tray 701 thereafter. That is to say, the CPU 952 places the alignment operations for sheets on the stack tray 701 in a permitted state (state 1501). Then, if sheets start to be discharged and stacked on the stack tray 701, the CPU 952 places the stack tray 701 in the sheet surface detection state based on a signal output from the sheet sensor 721.

Subsequently, if a part of the sheets stacked on the stack tray 701 is removed, the sheet sensor 721 switches from the blocked state to the transmissive state, and a signal indicating the transmissive state is output to the CPU 952. In response, the CPU 952 determines that a part of the sheets stacked on the stack tray 701 has been removed, that is to say, the amount of sheets stacked on the stack tray 701 has decreased, and places the alignment operations (alignment process) for the sheets on the stack tray 701 in an inhibited state (state 1502). Consequently, even if sheets are discharged and stacked on the stack tray 701 thereafter, the alignment operations for sheets using the alignment plates 711*a* and 712*b* are not executed, thereby making it possible to prevent the occurrence of the above-mentioned problem caused by the execution of the alignment operations.

In the present embodiment, the inhibition of the alignment operations for sheets may further be cancelled in accordance with a change in the stacked state of sheets on the stack tray 701. More specifically, if all of sheets stacked on the stack tray 701 are removed from the stack tray 701, the inhibition of the alignment operations (alignment process) may be cancelled. This is because, if all of discharged sheets are removed from the stack tray 701, the above-mentioned misalignment in the stacked sheets is resolved, and therefore the alignment operations for sheets that are to be discharged thereafter do not cause the occurrence of the above-mentioned problem.

If all of sheets stacked on the stack tray 701 are removed while the alignment operations are in the inhibited state (1502), the sheet sensor 731 detects no sheet on the stack tray 701, and a signal indicating the detection of no sheet is output to the CPU 952. In response, the CPU 952 determines that all of sheets stacked on the stack tray 701 have been removed, that is to say, the amount of sheets stacked on the stack tray 701 has reached 0 (zero), and places the alignment operations (alignment process) for sheets on the stack tray 701 in the permitted state (state 1501). In the above manner, if the alignment operations for sheets have been interrupted, it is possible to automatically resume the alignment operations for sheets and provide the user with sheets to which the alignment process has been applied in accordance with a change in the stacked state of sheets on the stack tray 700.

<Procedure of Processing for Execution of Print Job>

Figure 16:
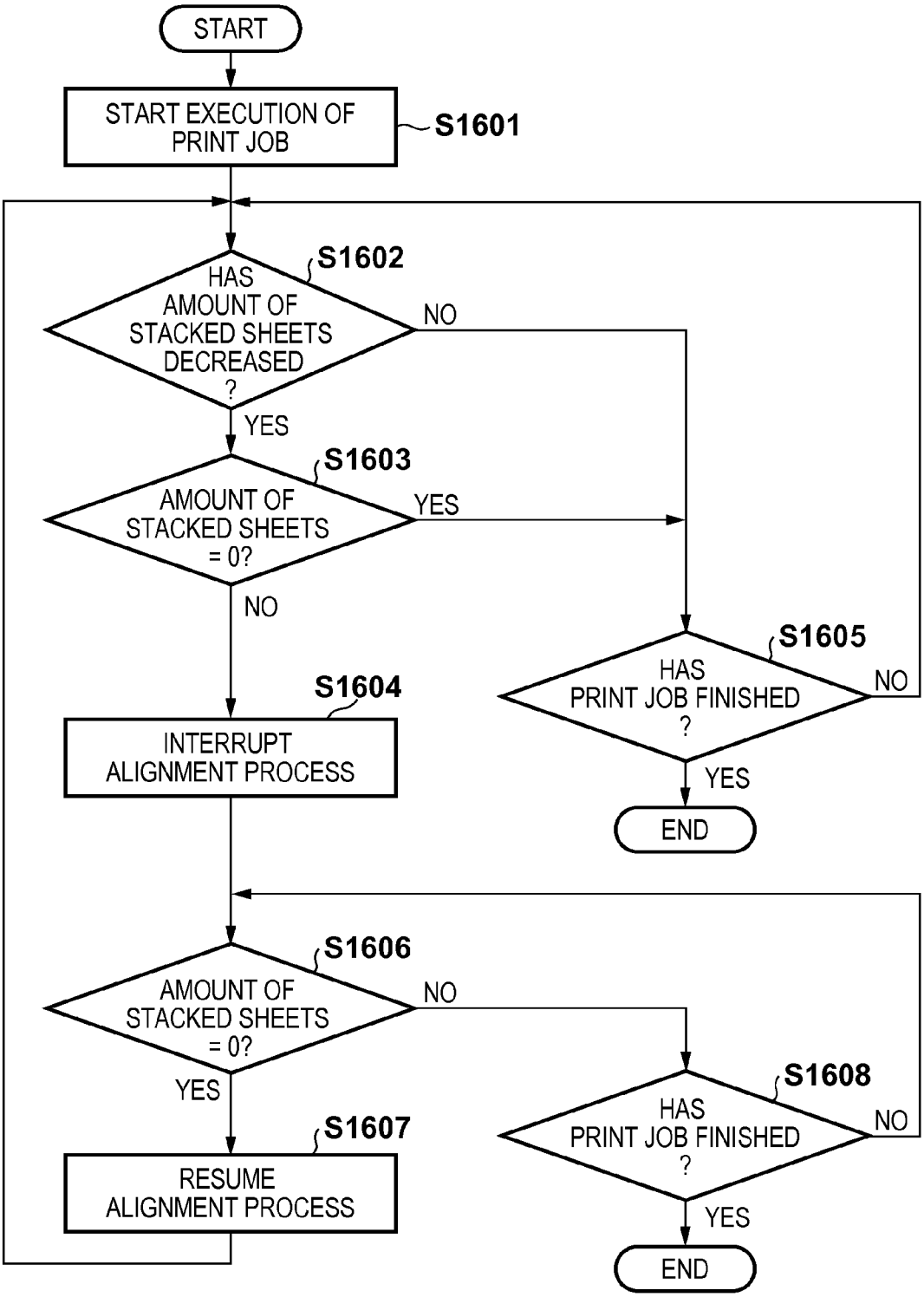
FIG. 16 is a flowchart showing a procedure of sheet processing according to the first embodiment.

With reference to FIG. 16, the following describes a procedure of sheet processing for the execution of a print job according to the present embodiment. Note that the processes of steps in this flowchart are realized in the finisher 500 by the CPU 952 in the finisher controller 951 reading a program stored in the ROM 953 to the memory unit 954 and executing the read program. Also, the execution of a print job is realized by the CPU 901 in the image forming apparatus 10 reading a program stored in the ROM 902 to the memory unit 903 and executing the read program.

First, in step S1601, the CPU 901 starts the execution of the print job. It will be assumed that, in the print job, the execution of an alignment process in the finisher 500 is designated, and the stack tray 701 is designated as a discharge destination for sheets to which the image forming apparatus 10 has applied a print process. It should be noted, however, that the CPU 952 can control each of the stack trays 700 and 701 independently. In accordance with an instruction from the CPU 901, the CPU 952 controls the finisher 500 to discharge conveyed sheets onto the stack tray 701 and apply an alignment process to the discharged sheets using the alignment plates 711*a* and 711*b*. While the sheets are being stacked on the stack tray 701, the CPU 952 performs control to place the stack tray 701 in the sheet surface detection state as described earlier.

During the execution of the print process and the alignment process based on the print job, the CPU 952 determines in step S1602 whether or not a part of sheets stacked on the stack tray 701 has been removed (that is to say, the amount of stacked sheets has decreased) based on a signal output from the sheet sensor 721. If the CPU 952 determines that the amount of stacked sheets has decreased, it proceeds to the process of step S1603 and determines whether or not all of the stacked sheets have been removed (that is to say, the amount of stacked sheets has reached 0) based on a signal output from the sheet sensor 731. If the CPU 952 determines that the amount of stacked sheets has not reached 0, it proceeds to the process of step S1604 and controls the finisher 500 to interrupt the alignment process. Thereafter, the processing moves to step S1606.

On the other hand, if the CPU 952 determines in step S1602 that the amount of stacked sheets has not decreased, it proceeds to the process of step S1605 and determines whether or not the execution of the print job has finished. Unless the execution of the print job has finished, the CPU 952 returns to the process of step S1602 and controls the finisher 500 to continue the alignment process for the sheets stacked on the stack tray 701. This is because, if a part of the sheets has not been removed from the stack tray 701, there will be no occurrence of a reduction in the sheet quality caused by the alignment process for sheets stacked in a misaligned manner.

If the CPU 952 determines in step S1603 that the amount of stacked sheets has reached 0, it proceeds to the process of step S1605 without interrupting the alignment process, and determines whether or not the execution of the print job has finished. Unless the execution of the print job has finished, the CPU 952 returns to the process of step S1602 and controls the finisher 500 to continue the alignment process for the sheets stacked on the stack tray 701. This is because, if all of the sheets have been removed from the stack tray 701, there will be no occurrence of the state where sheets are stacked in a misaligned manner, and there will be no occurrence of a reduction in the sheet quality caused by the alignment process.

While the alignment process is being interrupted, the CPU 952 determines in step S1606 whether or not all of the stacked sheets have been removed (that is to say, the amount of stacked sheets has reached 0) based on a signal output from the sheet sensor 731. If the CPU 952 determines that the amount of stacked sheets has reached 0, it proceeds to the process of step S1607, controls the finisher 500 to resume the alignment process that has been interrupted, and returns to the process of step S1602. On the other hand, if the CPU 952 determines that the amount of stacked sheets has not reached 0, it proceeds to the process of step S1608 and determines whether or not the execution of the print job has finished. Unless the execution of the print job has finished, the CPU 952 returns to the process of step S1606 and repeats the determination process of step S1606.

In the case where the CPU 952 determines that the execution of the print job has finished in step S1605 or step S1606, if the alignment process be in execution, it waits until all sheets are discharged and then completes the alignment process. Thereafter, the sequence of processes is ended.

As described above, even when the removal of a part of sheets stacked on the stack trays 700 and 701 has led to misalignment of the stacked sheets, it is possible to prevent a reduction in the sheet quality caused by the alignment process for sheets. Furthermore, if all of the sheets stacked on the stack trays 700 and 701 are removed during the inhibition of the alignment process, the inhibition of the alignment operations for sheets is cancelled; as a result, the alignment process can be resumed at an appropriate timing, and the user can be provided with sheets to which the alignment process has been applied.

Second Embodiment

In the first embodiment, after an alignment process for sheets is interrupted, the alignment process for sheets is not resumed unless all of sheets stacked on the stack trays 700 and 701 are removed. For this reason, in the case where, for example, the image forming apparatus 10 is shared among a plurality of users, the alignment process cannot be applied to sheets corresponding to a print job for which the execution is instructed by a certain user unless all of the stacked sheets are removed by any of the users while the alignment process is being interrupted. In view of this, it would be desirable to provide a mechanism for automatically resuming the alignment process even if all of the stacked sheets are not removed.

In a second embodiment, the alignment process is resumed in accordance with the positions of the stack trays 700 and 701 in the vertical direction (or the amount of stacked sheets), not only if all of sheets stacked on these stack trays are removed, but also if a part of the sheets stacked on these stack trays is removed. In this way, the alignment process can be resumed automatically without the occurrence of a reduction in the sheet quality caused by the alignment process for sheets stacked in a misaligned manner.

<Procedure of Processing for Execution of Print Job>

Figure 17:
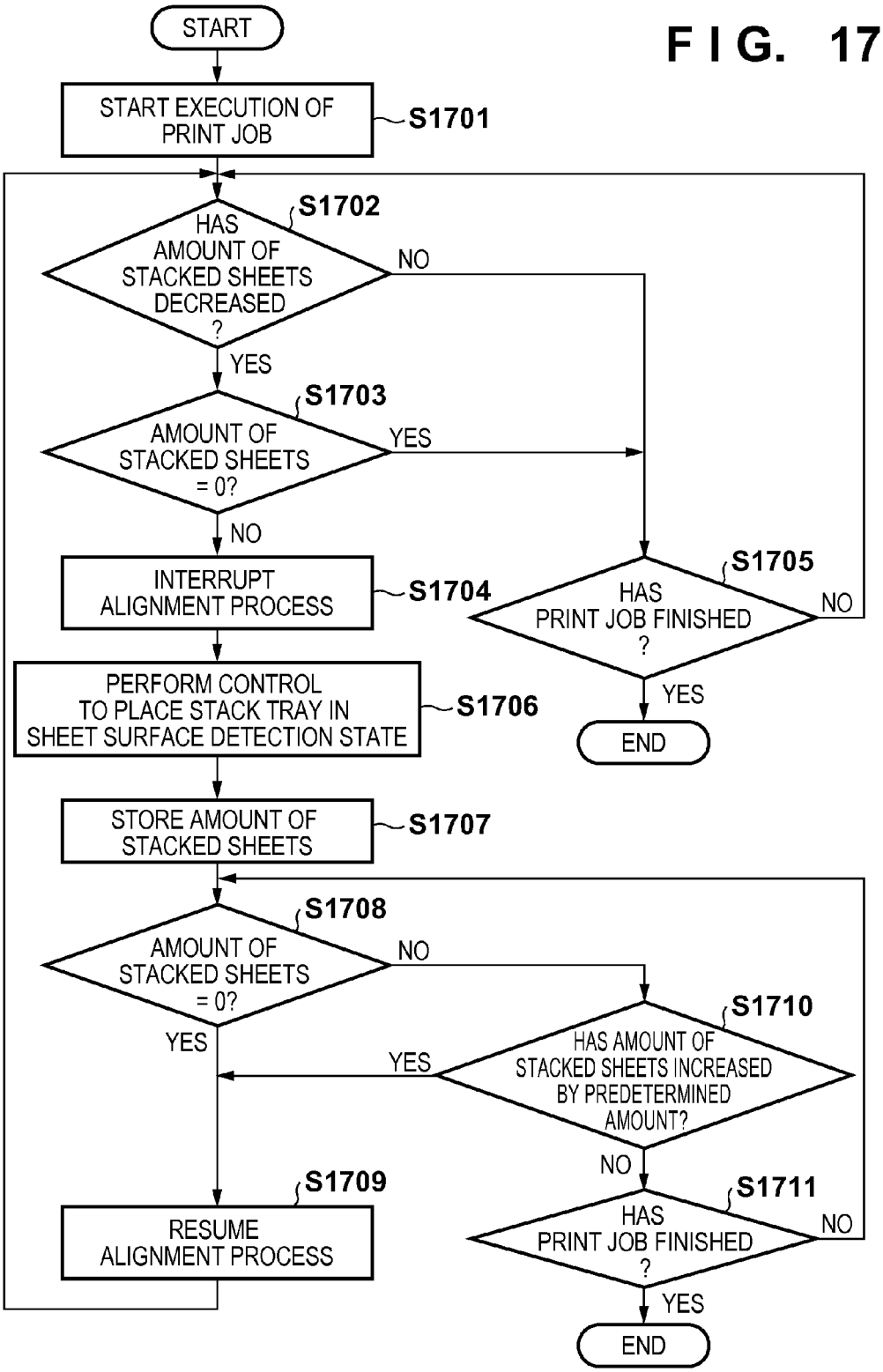
FIG. 17 is a flowchart showing a procedure of sheet processing according to a second embodiment.

With reference to FIG. 17, the following describes a procedure of sheet processing for the execution of a print job according to the present embodiment. Similarly to the first embodiment (FIG. 16), the processes of steps in this flowchart are realized in the finisher 500 by the CPU 952 in the finisher controller 951 reading a program stored in the ROM 953 to the memory unit 954 and executing the read program. Also, the execution of a print job is realized by the CPU 901 in the image forming apparatus 10 reading a program stored in the ROM 902 to the memory unit 903 and executing the read program. The following description is simplified by focusing on the portions that are different from the first embodiment.

In step S1701, the CPU 901 starts the execution of the print job. Then, in accordance with an instruction from the CPU 901, the CPU 952 controls the finisher 500 to discharge conveyed sheets onto the stack tray 701 and apply an alignment process to the discharged sheets using the alignment plates 711*a* and 711*b*. Note that step S1701 to step S1705 are similar to step S1601 to step S1605 according to the first embodiment. In step S1704, the CPU 952 controls the finisher 500 to interrupt the alignment process and proceeds to the process of step S1706.

In step S1706, the CPU 952 performs control to place the stack tray 701, on which the amount of stacked sheets has decreased as a result of removing a part of the sheets, in the sheet surface detection state again. The CPU 952 adjusts the position (height) of the stack tray 701 by controlling the tray elevator motor M16 to place the stack tray 701 in the sheet surface detection state. Furthermore, in step S1707, the CPU 952 identifies the position of the stack tray 701 based on the state of the tray elevator motor M16. It should be noted here that, while in the sheet surface detection state, the position of the stack tray 701 changes in accordance with the amount of stacked sheets. Therefore, the CPU 952 stores, in the memory unit 954, information indicating the position of the stack tray 701 as the amount of stacked sheets upon interrupting the alignment process.

Next, in step S1708, the CPU 952 determines whether or not the amount of sheets stacked on the stack tray 701 has reached 0, similarly to step S1606. If the CPU 952 determines that the amount of stacked sheets has reached 0, it controls the finisher 500 to resume the alignment process in step S1709, similarly to step S1607. On the other hand, if the CPU 952 determines that the amount of stacked sheets has not reached 0, it proceeds to the process of step S1710.

In step S1710, the CPU 952 determines whether or not the amount of sheets stacked on the stack tray 701 has increased by a predetermined amount from the amount of stacked sheets upon interrupting the alignment process for sheets (that is to say, upon removal of a part of the stacked sheets). Note that the predetermined amount denotes an amount of stacked sheets equivalent to the size of the alignment members 711*a* and 711*b* in the vertical direction.

If the alignment members 711*a* and 711*b* are operated after removing a part of the stacked sheets, there is a possibility that the alignment members 711*a* and 711*b* may come into contact with sheets remaining on the stack tray 701. On the other hand, if the stack tray 701 is in the sheet surface detection state, there is a possibility that the alignment process can be resumed after a predetermined amount of sheets are newly stacked on the sheets remaining on the stack tray 701 through the execution of the print job. More specifically, the stack tray 701 in the sheet surface detection state is lowered by the tray elevator motor M16 in accordance with stacking of sheets. In this way, when the stack tray 701 is lowered to a position where the alignment members 711*a* and 711*b* do not come into contact with the sheets that have remained on the stack tray 701 after removing a part of the sheets, the above-mentioned reduction in the sheet quality does not occur even if the alignment process is resumed.

Therefore, when the stack tray 701 is lowered from a position where a part of the sheets remaining on the stack tray 701 was removed by a distance corresponding to the size of the alignment members 711*a* and 711*b* in the vertical direction, the alignment process can be resumed without reducing the sheet quality. In the present embodiment, if the CPU 952 determines in step S1710 that the amount of stacked sheets has increased by the predetermined amount, it controls the finisher 500 to resume the alignment process that has been interrupted, and returns to the process of step S1702. On the other hand, if the CPU 952 determines in step S1710 that the amount of stacked sheets has not increased by the predetermined amount, it proceeds to the process of step S1711 and determines whether or not the execution of the print job has finished. Unless the execution of the print job has finished, the CPU 952 returns to the process of step S1708 and repeats the determination processes of step S1708 and step S1710.

As described above, according to the present embodiment, even when the removal of a part of sheets stacked on the stack trays 700 and 701 has led to misalignment of the stacked sheets, it is possible to prevent a reduction in the sheet quality caused by the alignment process for sheets. Furthermore, even if all of the stacked sheets are not removed during the inhibition of the alignment process, it is possible to automatically cancel the inhibition of the alignment process and resume the alignment process, without reducing the sheet quality due to the alignment process.

Other Embodiments

The above embodiments have described the example in which the sheet sensor 721 detects the removal of sheets from a stack tray. The present invention, however, is not limited in this way; alternatively, the removal of sheets on a stack tray may be detected by providing the stack tray with a sensor that measures the weight of sheets stacked on the stack tray. For example, the CPU 952 may determine that a part of sheets on the stack tray has been removed if the weight of the sheets on the stack tray has decreased from 20 g to 10 g. On the other hand, the CPU 952 may determine that all of the sheets on the stack tray have been removed if the weight of the sheets on the stack tray has decreased from 20 g to 0 g.

The control performed by the CPU 901 and the CPU 952 in the above-described embodiments may instead be performed by a single CPU. In this case, that CPU may be included either in the image forming apparatus 10 or in the finisher 500.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-264736, filed Dec. 3, 2012, which is hereby incorporated by reference herein in its entirety.

What is claimed is:

1. A sheet processing apparatus comprising:

a stacking control unit configured to control to stack sheets on a stack tray;

an alignment unit configured to align sheets stacked on the stack tray;

a determination unit configured to determine whether or not a part of sheets stacked on the stack tray has been removed from the stack tray; and a control unit configured to inhibit alignment by the alignment unit in a case where the determination unit determines that a part of sheets stacked on the stack tray has been removed from the stack tray.

2. The sheet processing apparatus according to claim 1, wherein when the alignment has been inhibited by the control unit, the determination unit further determines whether or not all of sheets stacked on the stack tray have been removed from the stack tray, and when the determination unit determines that all of sheets stacked on the stack tray have been removed from the stack tray, the control unit cancels inhibition of the alignment.

3. The sheet processing apparatus according to claim 2, further comprising an execution unit configured to execute a print job upon accepting the print job, wherein the control unit:

causes the alignment unit to apply the alignment to sheets that have been discharged and stacked on the stack tray through execution of the print job by the execution unit;

causes the alignment unit to interrupt the alignment in a case where the determination unit determines that a part of sheets stacked on the stack tray has been removed from the stack tray; and causes the alignment unit to resume the alignment in a case where the determination unit determines that all of sheets stacked on the stack tray have been removed from the stack tray.

4. The sheet processing apparatus according to claim 2, further comprising:

a first sensor configured to detect removal of a part of sheets stacked on the stack tray; and a second sensor configured to detect a presence or an absence of sheets stacked on the stack tray, wherein the determination unit:

determines that a part of sheets stacked on the stack tray has been removed from the stack tray in a case where the first sensor detects the removal of the part of sheets stacked on the stack tray, and determines that all of sheets stacked on the stack tray have been removed from the stack tray in a case where the second sensor detects no sheet.

5. The sheet processing apparatus according to claim 4, further comprising a lifting unit configured to lift the stack tray up and down, wherein the control unit causes the lifting unit to lift, while sheets are being stacked on the stack tray, the stack tray up and down to a position where a topmost sheet out of the stacked sheets is detected by the first sensor, and in a case where the first sensor detects a disappearance of the topmost sheet that has been detected, the first sensor outputs, to the determination unit, a signal indicating a removal of a part of sheets stacked on the stack tray.

6. The sheet processing apparatus according to claim 2, further comprising a lifting unit configured to lift the stack tray up and down, wherein the control unit:

causes the lifting unit to lift the stack tray down in accordance with stacking of discharged sheets on the stack tray so as to enable the alignment unit to perform the alignment to the sheets stacked on the stack tray, and causes the alignment unit to perform the alignment to the stacked sheets while the stack tray is being lifted down; and after inhibiting the alignment, cancels inhibition of the alignment in a case where the stack tray has been lifted down to a position where the alignment unit does not come into contact with sheets that have remained on the stack tray after a part of stacked sheets has been removed.

7. The sheet processing apparatus according to claim 6, wherein the position where the alignment unit does not come into contact with the sheets that have remained on the stack tray after the part of stacked sheets has been removed, is a position that is below a position of the stack tray upon removal of the part of stacked sheets by a distance corresponding to a size of the alignment unit in a vertical direction.

8. The sheet processing apparatus according to claim 6, further comprising a detection unit configured to detect an amount of sheets stacked on the stack tray, wherein after inhibiting the alignment, the control unit cancels inhibition of the alignment in a case where the amount of stacked sheets detected by the detection unit has increased from an amount of stacked sheets upon removal of a part of sheets stacked on the stack tray by an amount corresponding to a size of the alignment unit in a vertical direction.

9. A sheet processing apparatus comprising:

a stacking control unit configured to control to stack sheets on a stack tray;

an alignment unit configured to align sheets stacked on the stack tray; and a control unit configured to inhibit a process for alignment by the alignment unit, wherein when all of sheets stacked on the stack tray have been removed from the stack tray, the control unit cancels inhibition of the alignment.

10. The sheet processing apparatus according to claim 9, wherein the control unit inhibits the alignment when sheets stacked on the stack tray satisfy a predetermined condition.

11. The sheet processing apparatus according to claim 9, further comprising a determining unit configured to determine whether all of sheets stacked on the stack tray have been removed from the stack tray, wherein, when the determining unit determines that all of sheets stacked on the stack tray have been removed from the stack tray, the control unit cancels inhibition of the alignment.

12. The sheet processing apparatus according to claim 11, further comprising a sensor configured to detect a presence or an absence of sheets stacked on the stack tray, wherein the determining unit determines that all of sheets stacked on the stack tray have been removed from the stack tray, in a case that the sensor detects no sheet.

13. The sheet processing apparatus according to claim 9, further comprising a printing unit configured to print images on sheets, wherein the stacking control unit is configured to control to stack the sheets on which the images have been printed by the printing unit.

14. A control method for a sheet processing apparatus that includes a stacking control unit configured to control to stack sheets on a stack tray and an alignment unit configured to align sheets stacked on the stack tray, the control method comprising steps of:

determining whether or not a part of sheets stacked on the stack tray has been removed from the stack tray; and inhibiting alignment by the alignment unit in a case where it has been determined that a part of sheets stacked on the stack tray has been removed from the stack tray.

15. A non-transitory computer-readable storage medium storing a program for causing a computer to execute steps of a control method for a sheet processing apparatus that includes a stacking control unit configured to control to stack sheets on a stack tray and an alignment unit configured to align sheets stacked on the stack tray, the control method comprising steps of:

determining whether or not a part of sheets stacked on the stack tray has been removed from the stack tray; and inhibiting alignment by the alignment unit in a case where it has been determined that a part of sheets stacked on the stack tray has been removed from the stack tray.

* * * * *